US005350666A

United States Patent [19]

Motoki et al.

[11] Patent Number: 5,350,666

[45] Date of Patent: Sep. 27, 1994

[54] SILVER HALIDE PHOTOGRAPHIC MATERIALS

[75] Inventors: Masuji Motoki; Atsuhiro Ohkawa; Keiji Mihayashi, all of Kanagawa, Japan

[73] Assignee: Fuji Photo Film Co., Ltd., Kanagawa, Japan

[21] Appl. No.: 721,006

[22] Filed: Jun. 26, 1991

[30] Foreign Application Priority Data

Jun. 28, 1990 [JP] Japan ..... 2-170832

[51] Int. Cl.[5] ..... G03C 7/32; G03C 7/36; G03C 7/38

[52] U.S. Cl. ..... 430/544; 430/552; 430/553; 430/554; 430/555; 430/556; 430/557; 430/558; 430/957

[58] Field of Search ..... 430/544, 955, 956, 957, 430/958, 959, 960, 552, 553, 554, 555, 556, 557, 558

[56] References Cited

U.S. PATENT DOCUMENTS

| | | | |
|---|---|---|---|
| 4,409,323 | 10/1983 | Sato et al. | 430/544 |
| 4,421,845 | 12/1983 | Uemura et al. | 430/544 |
| 4,861,701 | 8/1989 | Burns et al. | 430/543 |
| 4,871,654 | 10/1989 | Vanmaele et al. | 430/955 |
| 4,994,363 | 2/1991 | Koya et al. | 430/954 |
| 5,071,735 | 12/1991 | Ichijima et al. | 430/544 |

FOREIGN PATENT DOCUMENTS

| | | | |
|---|---|---|---|
| 0283242 | 9/1988 | European Pat. Off. | 430/544 |
| 0383623 | 8/1990 | European Pat. Off. | 430/957 |
| 60-218645 | 11/1985 | Japan . | |
| 63-259556 | 10/1988 | Japan | 430/544 |
| 63-304254 | 12/1988 | Japan | 430/544 |
| 1154057 | 6/1989 | Japan . | |
| 1280755 | 11/1989 | Japan . | |

OTHER PUBLICATIONS

Translation of JP-01-154057 (Jun. 1989).

Patent Abstracts of Japan, vol. 13, No. 422(P-933)(3770), Sep. 20, 1989.

Patent Abstracts of Japan, vol. 14, No. 54 (P-999)(3997), Jan. 31, 1990.

*Primary Examiner*—Charles L. Bowers, Jr.
*Assistant Examiner*—Martin Angebranndt
*Attorney, Agent, or Firm*—Sughrue, Mion, Zinn, Macpeak & Seas

[57] ABSTRACT

A silver halide photographic material having on a support, at least one photosensitive silver halide emulsion layer, which contains a coupler which releases at least two groups selected from the group consisting of a photographically useful group and a precursor thereof via a timing group upon undergoing a coupling reaction with an oxidized product of a developing agent, in which a plurality of photographically useful groups or precursors thereof are present on different atoms of the timing group, provided that when the plurality of photographically useful groups have a different function to each other, the timing group is not a group utilizing an intramolecular nucleophilic substitution reaction.

10 Claims, No Drawings

SILVER HALIDE PHOTOGRAPHIC MATERIALS

FIELD OF THE INVENTION

The present invention relates to a silver halide photographic material. More particularly, the present invention relates to couplers with which a plurality of photographically useful groups are released from an eliminated timing group.

BACKGROUND OF THE INVENTION

Recently, a demand has arisen for silver halide photographic materials, and especially color photographic materials for cameras having excellent graininess and sharpness at high photographic speeds, and also having excellent storage properties, as typified by the ISO 400 photograhic materials (Super HG-400 manufactured by Fuji Photo Film Co., Ltd.) which have as high image quality as that of the ISO speed 100.

Methods in which photographically useful groups are bonded to the coupling position of a coupler via a timing group and released at an appropriate time and in the form of the image during photographic processing are known to improve image quality. These methods have been disclosed, for example, in U.S. Pat. No. 4,409,323 and JP-A-60-218645. (The term "JP-A" as used herein signifies an "unexamined published Japanese patent application".)

The methods disclosed involve the release of one molecule of a photographically useful group from one molecule of a coupler.

However, if these couplers are present in the film in large amounts, the film thickness of the photosensitive material is increased, and there is an adverse effect on sharpness and an increase in cost.

Couplers having two photographically useful groups which are present on different atoms of electron transfer timing groups are disclosed in U.S. Pat. No. 4,861,701, and couplers having two photographically useful groups which are present on a single carbon atom of a timing group are disclosed in JP-A-l-154057. However, these couplers release the photographically useful groups even by hydrolysis, and their stability is not sufficient.

SUMMARY OF THE INVENTION

An object of the present invention is to provide a silver halide photographic material which has excellent sharpness, graininess and color reproduction characteristics and which is inexpensive to produce.

This and other objects of the present invention have been realized by means of a silver halide photographic material having on a support, at least one photosensitive silver halide emulsion layer, which contains a coupler which releases a photographically useful group or a precursor thereof via a timing group upon undergoing a coupling reaction with an oxidized product of a developing agent, wherein a plurality of photographically useful groups or precursors thereof are present on different atoms of the timing group.

However, when plural photographically useful groups have different functions to each other, the timing group is not the group utilizing an intramolecular nucleophilic substitution reaction. The function of the photographically useful group means, for example, a function exhibited by a development inhibitor, a dye, a fogging agent, a developing agent, a coupler, a bleaching accelerator or a fixing accelerator.

DETAILED DESCRIPTION OF THE INVENTION

The compounds of the present invention can be represented by general formula (I) illustrated below.

$$A-(L_1)_l-(L_2)_m+(L_1)_n-PUG]_s \quad (I)$$

In this formula, A represents a coupler residual group, $L_1$ represents a divalent timing group, $L_2$ represents a timing group having a valence of 3 or more and PUG represents a photographically useful group. Further, l and n each individually represents 0, 1 or 2, m represents 1 or 2, and s represents a number obtained by subtracting 1 from the valence of $L_2$, being an integer of at least 2. Furthermore, when there is a plurality of $L_1$ groups within the molecule plural $L_1$ groups may be the same or different. The same thing as above can be said when there is a plurality of $L_2$ groups within the molecule. In addition, the plurality of PUGs may be the same or different, and plural $(-(L_1)_n-PUG)_s$ are bonded to different atoms of $L_2$.

The compounds represented by general formula (I) are described in detail below.

In general formula (I), A represents a coupler residual group.

For example, A represents a yellow coupler residual group (for example, an open chain ketomethylene type), a magenta coupler residual group (for example, a 5-pyrazolone type, a pyrazoloimidazole type, or a pyrazolotriazole type), a cyan coupler residual group (for example, a phenol type or naphthol type) or a non-color forming coupler residual group (for example, an indanone type or an acetophenone type). Furthermore, A may represent a heterocyclic coupler residual group such as disclosed in U.S. Pat. Nos. 4,315,070, 4,183,752, 3,961,959 or 4,171,223.

Preferred examples of A can be represented by general formulae (Cp-1), (Cp-2), (Cp-3), (Cp-4), (Cp-5), (Cp-6), (Cp-7), (Cp-8), (Cp-9) or (Cp-10). These preferred coupler residual groups have a high coupling rate.

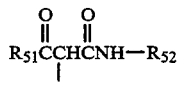
(Cp-1)

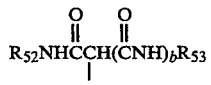
(Cp-2)

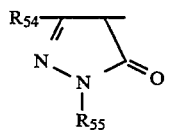
(Cp-3)

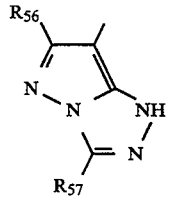
(Cp-4)

-continued (Cp-5)

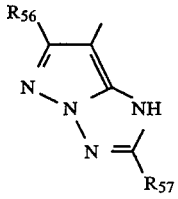

(Cp-6)

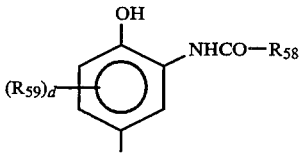

(Cp-7)

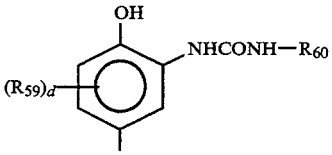

(Cp-8)

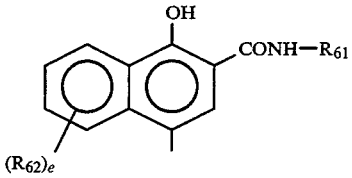

(Cp-9)

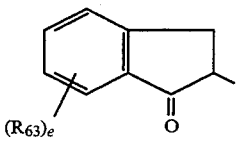

(Cp-10)

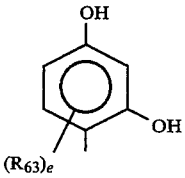

In the above general formulae, the free bond extending from the coupling position indicates the location at which a coupling leaving group is connected to Cp.

When $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ in these formulae includes a ballast group, the ballast group is selected such that the total number of carbon atoms therein is from 8 to 40, and preferably from 10 to 30. When $R_{51}$ to $R_{43}$ does not contain a ballast group, it is selected so that the total number of carbon atoms therein is preferably not more than 15. In the case of bis, telomeric or polymeric type couplers, any of the above mentioned $R_{51}$ to R63 substituent groups may form a divalent group which links the repeating units together. In this case, the number of carbon atoms may be outside the range specified above.

$R_{51}$–$R_{63}$, b, d and e are described in detail below.

Below, $R_{41}$ represents an aliphatic group, an aromatic group or a heterocyclic group, $R_{42}$ represents an aromatic group or a heterocyclic group and $R_{43}$, $R_{44}$ and $R_{45}$ each represents a hydrogen atom, an aliphatic group, an aromatic group or a heterocyclic group.

$R_{51}$ represents a group having the same meaning as $R_{41}$. Further, b represents 0 or 1. $R_{52}$ and $R_{53}$ each represent groups having same meaning as $R_{42}$, $R_{54}$ represents a group which has the same meaning as $R_{41}$, an $R_{41}CON(R_{43})$— group, an $R_{41}N(R_{43})$— group, an $R_{41}SO_2N(R_{43})$— group, an $R_{41}S$— group, an $R_{43}O$— group, an $R_{45}NCON(R_{43})(R_{44})$— group or an N≡C— group. $R_{55}$ represents a group which has the same meaning as $R_{41}$. $R_{56}$ and $R_{57}$ each represent a group which has the same meaning as $R_{43}$, an $R_{41}S$— group, an $R_{43}O$— group, an $R_{41}CON(R_{43})$— group or an $R_{41}SO_2N(R_{43})$— group. $R_{58}$ represents a group which has the same meaning as $R_{41}$. $R_{59}$ represents a group which has the same meaning as $R_{41}$, an $R_{41}CON(R_{43})$— group, an $R_{41}OCON(R_{43})$— group, an $R_{41}SO_2N(R_{43})$— group group, an $R_{41}O$— group, an $R_{41}S$— group, a halogen atom or an $R_{41}N(R_{43})$— group. Further, d represents an integer from 0 to 3. When d is 2 or 3, the plural $R_{59}$ groups may be the same or different groups. The $R_{59}$ groups may be divalent groups which are joined together to form ring structures. Typical examples of ring structures formed from the divalent groups of $R_{59}$ include the

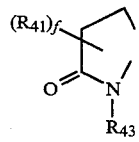

group and the

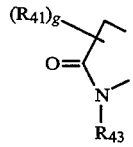

group, in which f represents an integer from 0 to 4, and g represents an integer from 0 to 2. $R_{60}$ represents a group which has the same meaning as $R_{41}$. $R_{61}$ represents a group which has the same meaning as $R_{41}$, and $R_{62}$ represents a group which has the same meaning as $R_{41}$, an $R_{41}OCONH$— group, an $R_{41}SO_2NH$— group, an $R_{43}N(R_{44})CO(R_{45})$— group, an $R_{43}N(R_{44})SO_2N(R_{45})$— group, an $R_{43}O$— group, an $R_{41}S$— group, a halogen atom or an $R_{41}N(R_{43})$— group. $R_{63}$ represents a group which has the same meaning as $R_{41}$, an $R_{43}CON(R_{44})R_{45}$— group, an $R_{43}N(R_{44})CO$— group, an $R_{41}SO_2N(R_{44})$— group, an $R_{43}N(R_{44})SO_2$— group, an $R_{41}SO_2$— group, an $R_{43}OCO$— group, an $R_{43}$—$SO_2$— group, a halogen atom, a nitro group, a cyano group or an $R_{43}CO$— group. Further, e represents an integer from 0 to 4. When there is a plurality of $R_{62}$ or $R_{63}$ groups, these groups may each be the same or different.

In the foregoing description, the aliphatic groups represented by $R_{41}$ and $R_{43}$ to $R_{45}$ are saturated or unsaturated, chain like or cyclic, linear chain or branched, substituted or unsubstituted aliphatic hydrocarbyl groups which have from 1 to 32, and preferably from 1 to 22, carbon atoms. Typical examples include methyl, ethyl, propyl, iso-propyl, butyl, tert-butyl, iso-butyl, tert-amyl, hexyl, cyclohexyl, 2-ethylhexyl, octyl, 1,1,3,3-tetramethylbutyl, decyl, dodecyl, hexadecyl and octadecyl.

The aromatic groups represented by $R_{41}$ to $R_{45}$ are substituted or unsubstituted naphthyl groups or substituted or unsubstituted phenyl groups which preferably have from 6 to 20 carbon atoms.

The heterocyclic groups represented by $R_{41}$ to $R_{45}$ are preferably three to eight membered substituted or unsubstituted heterocyclic groups which have from 1 to 20, and preferably from 1 to 7, carbon atoms and in which the hetero atoms are selected from nitrogen, oxygen and sulfur atoms. Typical examples of these heterocyclic groups include 2-pyridyl, 2-thienyl, 2-furyl, 1,3,4-thiadiazol-2-yl, 2,4-dioxo-l,3-imidazolidin-5-yl, 1,2,4-triazol-2-yl and 1-pyrazolyl.

If the aforementioned aliphatic groups, aromatic groups and heterocyclic groups have substituents, typical examples of such substituents include a halogen atom, an $R_{47}O$— group, an $R_{46}S$— group, an $R_{47}CON(R_{48})$— group, an $R_{47}N(R_{48})CO$— group, an $R_{46}OCON(R_{47})$— group, an $R_{46}SO_2N(R_{47})$— group, an $R_{47}NSO_2(R_{48})$— group, an $R_{46}SO_2$ group, an $R_{47}OCO$— group, an $R_{47}NCON(R_{48})R_{49}$— group, a group which has the same meaning as $R_{46}$,

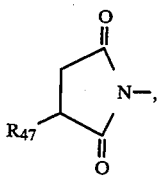

an $R_{46}COO$— group, an $R_{47}OSO_2$— group, a cyano group and a nitro group, wherein $R_{46}$ represents an aliphatic group, an aromatic group or a heterocyclic group, and $R_{47}$, $R_{48}$ and $R_{49}$ each represent an aliphatic group, an aromatic group, a heterocyclic group or a hydrogen atom. The aliphatic groups, aromatic groups and heterocyclic groups for $R_{46}$–$R_{49}$ are the same as those defined earlier for $R_{41}$, $R_{42}$, $R_{43}$, $R_{44}$ and $R_{45}$.

The preferred groups for $R_{51}$–$R_{63}$, and preferred values for d and e are described below.

$R_{51}$ is preferably an aliphatic group or an aromatic group. $R_{52}$, $R_{53}$ and $R_{55}$ are preferably aromatic groups.

$R_{54}$ is preferably an $R_{41}CONH$— group or an $R_{41}$—N($R_{43}$)— group. $R_{56}$ and $R_{57}$ are preferably aliphatic groups, aromatic groups, $R_{41}O$— groups or $R_{41}S$— groups.

In general formula (Cp-6), $R_{58}$ is preferably an aliphatic group or an aromatic group. $R_{59}$ is preferably a chlorine atom, an aliphatic group or an $R_{41}CONH$— group. Further, d is preferably 1 or 2.

In general formula (Cp-7), $R_{60}$ is preferably an aromatic group, and $R_{59}$ is preferably an $R_{41}CONH$— group. Further, d is preferably 1.

In general formula (Cp-8), $R_{61}$ is preferably an aliphatic group or an aromatic group and e is preferably 0 or 1. $R_{62}$ is preferably an $R_{41}OCONH$— group, an $R_{41}CONH$— group or an $R_{41}SO_2NH$— group, and these are preferably substituted in the 5-position of the naphthol ring.

In general formula (Cp-9), $R_{63}$ is preferably an $R_{41}CONH$— group, an $R_{41}SO_2NH$— group, an $R_{41}NSO_2(R_{43})$— group, an $R_{41}N(R_{43})CO$— group, a nitro group or a cyano group. In general formula (Cp-9), the suffix e is preferably 1 or 2.

In general formula (Cp-10), $R_{63}$ is preferably an $R_{43}N(R_{43})CO$— an $R_{43}OCO$— group or an $R_{43}CO$— group. In general formula (Cp-10), the suffix e is preferably 1 or 2.

Typical examples of $R_{51}$–$R_{63}$ are described below.

$R_{51}$ may be a tert-butyl, 4-methoxyphenyl, phenyl, 3-{2-(2,4-di-tert-amylphenoxy)butanamido}phenyl or methyl group.

$R_{52}$ and $R_{53}$ may be phenyl, 2-chloro-5-ethoxyphenyl, 2-chloro-5-dodecyloxycarbonylphenyl, 2-chloro-5-hexadecylsulfonamidophenyl, 2-chloro-5-tetradecanamidophenyl, 2-chloro-5-{4-(2,4-di-tert-amylphenoxy)butanamido}phenyl, 2-chloro-5-{2-(2,4-di-tert-amylphenoxy)butanamido}phenyl, 2-methoxyphenyl, 2-methoxy-5-tetra-decyloxycarbonylphenyl, 2-chloro-5-(1-ethoxycarbonylethoxycarbonyl)phenyl, 2-pyridyl, 2-chloro-5-octyloxycarbonylphenyl, 2,4-dichlorophenyl, 2-chloro-5-(1-dodecyloxycarbonylethoxycarbonyl)phenyl, 2-chlorophenyl or 2-ethoxyphenyl groups.

$R_{54}$ may be butanoylamino, 2-chloro-3-propanoylaminoanilino, 3-{2-(2,4-di-tert-amylphenoxy)butanamido} benzamido, 3-{4-(2,4-di-tert-amylphenoxy)butanamido}benzamido, 2-chloro-5-tetradecanamidoanilino, 5-(2,4-di-tert-amylphenoxyacetamido)benzamido, 2-chloro-5-dodecenylsuccinimidoanilino, 2-chloro-5-{2-(3-tert-butyl-4-hydroxyphenoxy)tetradecanamido}anilino, 2,2-dimethylpropanamido, 2-(3-pentadecylphenoxy)butanamido, pyrrolidino or N,N-dibutylamino group.

$R_{55}$ is preferably a 2,4,6-trichlorophenyl, 2-chlorophenyl, 2,5-dichlorophenyl, 2,3-dichlorophenyl, 2,6-dichloro-4-methoxyphenyl, 4-{2-(2,4-di-tert-amylphenoxy)butanamidophenyl or 2,6-dichloro-4-methanesulfonylphenyl group.

$R_{56}$ may be a methyl, ethyl, isopropyl, methoxy, ethoxy, methylthio, ethylthio, 3-phenylureido or 3-(2,4-di-tert-amylphenoxy)propyl group.

$R_{57}$ may be a 3-(2,4-di-tert-amylphenoxy)propyl, 3-[4-{2-[4-(4-hydroxyphenylsulfonyl)phenoxy]tetradecanamido}phenyl]propyl, methoxy, methylthio, ethylthio, methyl, 1-methyl-2-(2-octyloxy-5-[2-octyloxy-5- (1,1,3,3-tetramethylbutyl )phenylsulfonamido]phenylsulfonamido) ethyl, 3-{4-(4-dodecyloxyphenylsulfonamido)phenyl}propyl, 1,1-dimethyl-2-(2-octyloxy-5-(1,1,3,3-tetramethylbutyl)-phenylsulfonamidoethyl or dodecylthio group.

$R_{58}$ may be a 2-chlorophenyl, pentafluorophenyl, heptafluoropropyl, 1-( 2,4-di-tert--amylphenoxy)propyl, 3-( 2,4-di-tert-amylphenoxy)propyl, 2,4-di-tert-amylmethyl or furyl group.

$R_{59}$ may be a chlorine atom or a methyl, ethyl, propyl, butyl, isopropyl, 2-(2,4-di-tert-amylphenoxy)-butanamido, 2-(2,4-di-tert-amylphenoxy)hexanamido, 2-(2,4-di-tert-octylphenoxy)octanamido, 2-(2-chlorophenoxy)tetradecanamido, 2-{4-(4-hydroxyphenylsulfonyl)phenoxy}tetradecanamido or 2-{2-(2,4-di-tert-amylphenoxyacetamido)phenoxy}butanamido group.

$R_{60}$ may be a 4-cyanophenyl, 2-cyanophenyl, 4-butylsulfonylphenyl, 4-propylsulfonylphenyl, 4-chloro-3-cyanophenyl, 4-ethoxy-carbonylphenyl or 3,4-dichlorophenyl group.

$R_{61}$ may be a propyl, 2-methoxyphenyl, dodecyl, hexadecyl, cyclohexyl, 3-(2,4-di-tert-amylphenoxy)propyl, 4-(2,4-di-tert-amylphenoxy)butyl, 3-dodecyloxypropyl, tert-butyl, 2-methoxy-5-dodecyloxycarbonylphenyl, or 1-naphthyl group.

$R_{62}$ may be an isobutyloxycarbonylamino, ethoxycarbonylamino, phenylsulfonylamino, methanesulfonamido, benzamido, trifluoroacetamido, 3-phenylureido, butoxycarbonylamino or acetamido group.

$R_{63}$ may be a 2,4-di-tert-amylphenoxyacetamido, 2-(2,4-di-tert-amylphenoxy)butanamido, hexadecylsulfonamido, N-methyl-N--octadecylsulfamoyl, N,N-dioctylsulfamoyl, 4-tert-octylbenzoyl, dodecyloxycarbonyl group, a chlorine atom, or a nitro, cyano, N-(4-(2,4-di-tert-amylphenoxy)butyl}carbamoyl, N-3-(2,4-di-tert-amylphenoxy)butyl}carbamoyl, N-3-(2,4-di-tert-amylphenoxy)propylsulfamoyl, methanesulfonyl or hexadecytsulfonyl group.

The groups indicated below are preferred for $L_1$ in general formula (I).

(1) Groups Utilizing a Hemi-acetal Cleavage Reaction

These groups are disclosed, for example, in U.S. Pat. No. 4,146,396, JP-A-60-249148 and JP-A-60-249149, and the groups represented by general formula (T-1) illustrated below. In this formula, * indicates the position at which A, $L_1$ or $L_2$ of the compound represented by general formula (I) is bonded, and ** indicates the position at which $L_1$, $L_2$ or PUG are bonded.

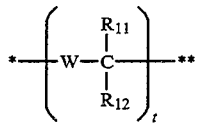

(T-1)

In this formula, W represents an oxygen atom, a sulfur atom or an

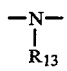

group, $R_{11}$ and $R_{12}$ each represents a hydrogen atom or a substituent group, $R_{13}$ represents a substituent group and t represents 1 or 2. When t is 2 the two

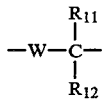

groups may be the same or different. Typical examples of $R_{11}$ and $R_{12}$ when they represent substituent groups, and $R_{13}$, include $R_{15}$, $R_{15}CO$—, $R_{15}SO_2$—,

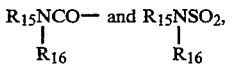

wherein $R_{15}$ represents an aliphatic group, an aromatic group or a heterocyclic group and $R_{16}$ represents a hydrogen atom, an aliphatic group, an aromatic group or a heterocyclic group. Those cases in which $R_{11}$, $R_{12}$ and $R_{13}$ each represent divalent groups which are joined together to form ring structures are also included. The aliphatic group, the aromatic group and the heterocyclic group represented by $R_{15}$ or $R_{16}$ each have the same meaning as those defined for $R_{41}$ to $R_{45}$. Actual examples of groups represented by general formula (T-1) are illustrated below.

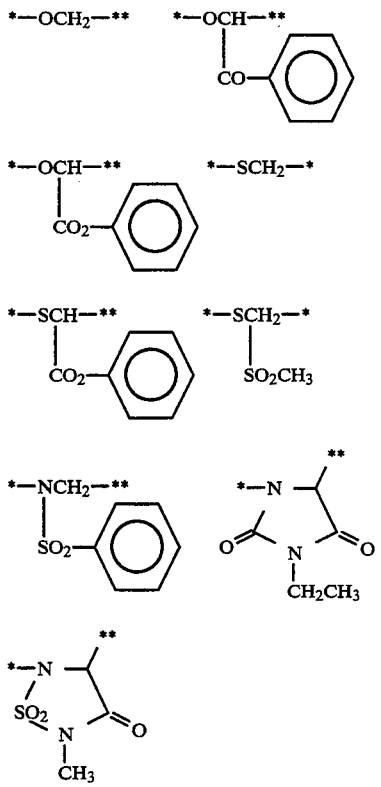

(2) Groups with which a Cleavage Reaction Occurs via an Intramolecular Nucleophilic-Substitution Reaction These groups include, for example, the timing groups disclosed in U.S. Pat. No. 4,248,292. These groups can be represented by the following general formula:

*—Nu—Link—E—** (T-2)

In this formula, Nu represents a nucleophilic group, in which oxygen and sulfur atoms are nucleophilic seeds, E represents an electrophilic group which can undergo a nucleophilic attack by Nu and with which the bond marked ** can be cleaved, and Link is a linking group which enables Nu and E to have a steric arrangement such that an intramolecular nucleophilic substitution reaction can occur. Actual examples of groups represented by general formula (T-2) are illustrated below.

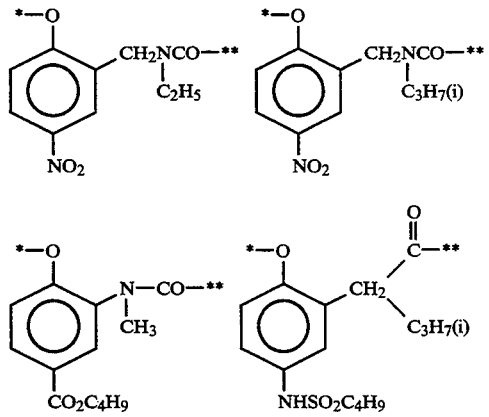

-continued

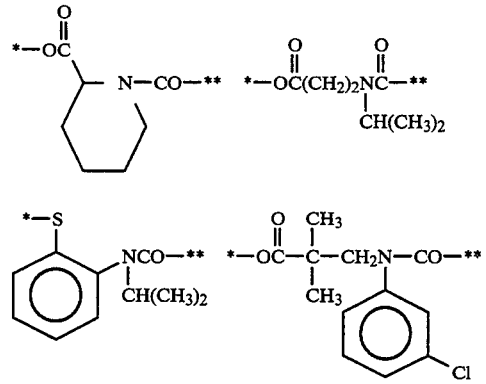

(3) Groups in which a Cleavage Reaction Occurs via an Electron Transfer Reaction along a Conjugated System These groups are disclosed, for example, in U.S. Pat. Nos. 4,409,323 and 4,421,845, JP-A-57-188035, JP-A-58-98728, JP-A-58-209736, JP-A-58-209737 and JP-A-58-209738, and the groups represented by general formula (T-3).

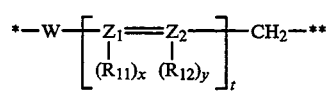

(T-3)

In this formula, *, **, W, $R_{11}$, $R_{12}$ and t all have the same meaning as described above in connection with general formula (T-1). However, $R_{11}$ and $R_{12}$ may be joined together to form a benzene ring or a structural part of a heterocyclic ring. Furthermore, $R_{11}$ or $R_{12}$ and W may be joined together to form a benzene ring or a heterocyclic ring.

$Z_1$ and $Z_2$ each independently represents a carbon atom or a nitrogen atom, and x and y represent 0 or 1. Thus, x is 1 when $Z_1$ is a carbon atom, and x is 0 when $Z_1$ is a nitrogen atom. The relationship between $Z_2$ and y is the same as that between $z_1$ and x. In addition, t represents 1 or 2, and t is 2 the two

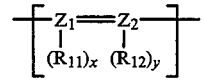

groups may be the same or different.

Actual examples of groups represented by general formula (T-3) are illustrated below.

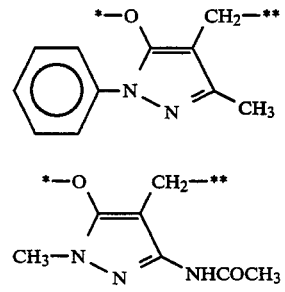

-continued

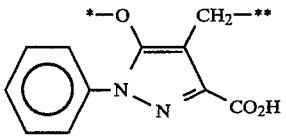

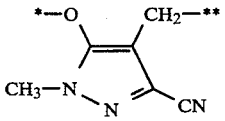

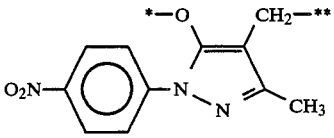

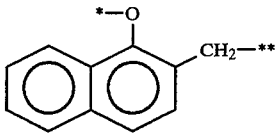

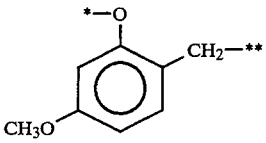

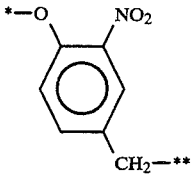

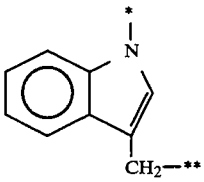

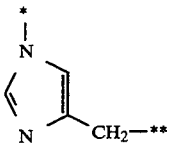

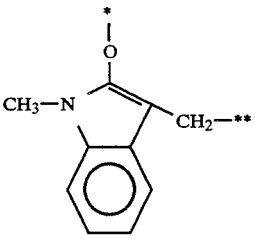

-continued

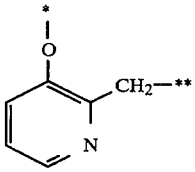

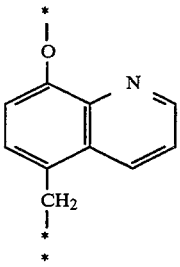

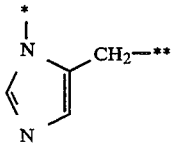

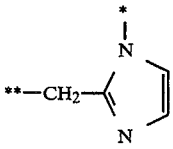

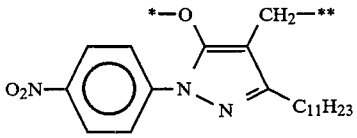

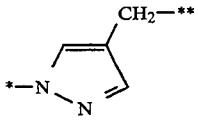

(4) Groups Utilizing a Cleavage Reaction due to Ester Hydrolysis

Examples of these groups include the linking groups disclosed in West German Patent laid open 2,626,315, and the groups (T-4) and (T-5) indicated below. In these formulae, * and ** have the same meaning as described in connection with general formula (T-1).

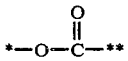

(T-4)

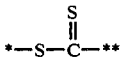

(T-5)

(5) Groups Utilizing an Iminoketal Cleavage Reaction

Examples of these groups include the linking groups disclosed in U.S. Pat. No. 4,546,073, and the groups represented by the general formula (T-6) indicated below.

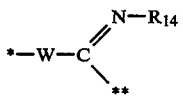

(T-6)

In this formula, *, ** and W have the same meaning as described in connection with general formula (T-1) and $R_{14}$ has the same meaning as $R_{13}$. Actual examples of groups represented by general formula (T-6) are indicated below.

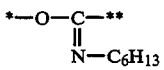

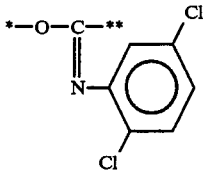

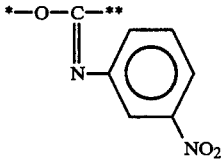

The groups represented by (T-I) to (T-5) are preferred for $L_1$, and those represented by (T-1) and (T-4) are especially desirable.

n is preferably 0 or 1.

n is preferably 0 or 1 and most desirably 0.

The groups represented by $L_2$ in general formula (I) are electron transfer timing groups having a valence of at least 3, and the groups which can be represented by general formula (T-$L_2$) indicated below are preferred.

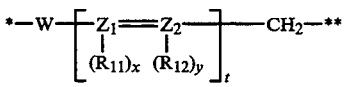

(T-$L_2$)

In this formula, W, $Z_1$, $Z_2$, $R_{11}$, $R_{12}$, x, y and t have the same meaning as those described in connection with general formula (T-3). Furthermore, * indicates the position at which A—$(L_1)_l$— in general formula (I) is bonded, and ** indicates the position at which —$(L_1)_n$—PUG is bonded. However, at least one of the plurality of $R_{11}$ or $R_{12}$ present is a group which is bonded to —$(L_1)_n$—PUG with a substituted or unsubstituted methylene group.

In formula (T-$L_2$) W is preferably a nitrogen atom, and more preferably W and $Z_2$ are bonded together to form a five membered ring and most preferably, W and $Z_2$ form an imidazole ring or a pyrazole ring.

Actual examples of (T-$L_2$) groups are indicated below, but the invention is not limited to these examples.

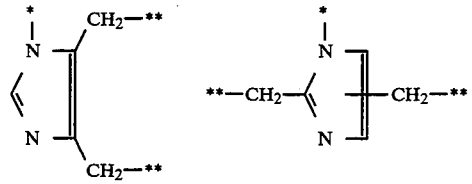

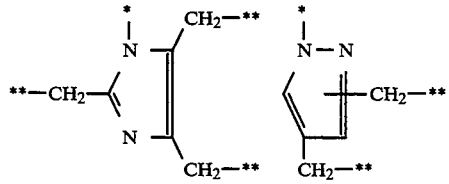

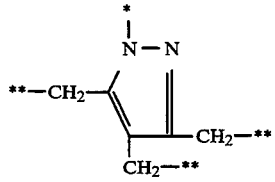

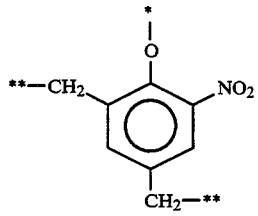

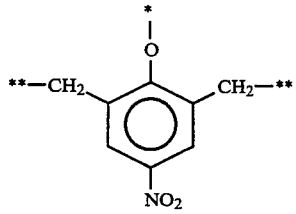

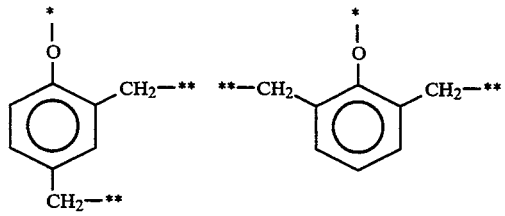

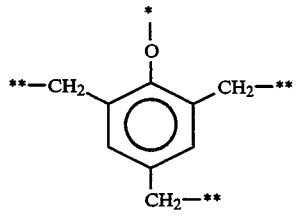

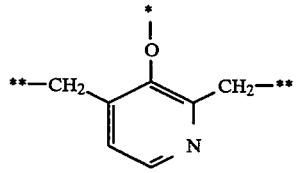

-continued

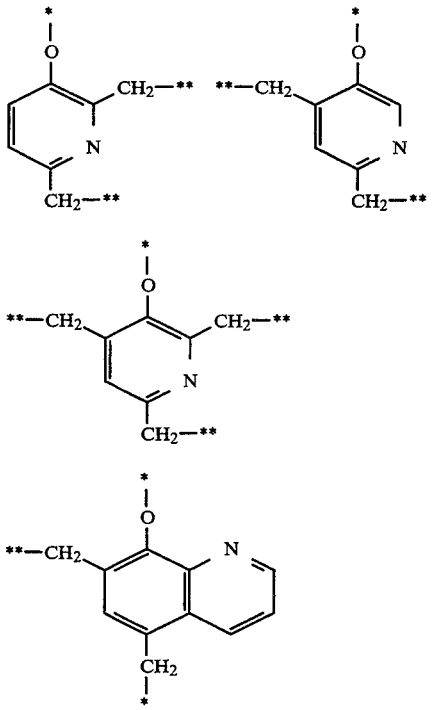

The groups illustrated above may have further substituent groups. Examples of such substituent groups include alkyl groups (for example, methyl, ethyl, isopropyl, t-butyl, hexyl, methoxymethyl, methoxyethyl, chloroethyl, cyanoethyl, nitroethyl, hydroxypropyl, carboxyethyl, dimethylaminoethyl, benzyl, phenethyl), aryl groups (for example, phenyl, naphthyl, 4-hydroxyphenyl, 4-cyanophenyl, 4-nitrophenyl, 2-methoxyphenyl, 2,6-dimethylphenyl, 4-carboxyphenyl, 4-sulfophenyl), heterocyclic groups (for example 2-pyridyl, 4-pyridyl, 2-furyl, 2-thienyl, 2-pyrrolyl), halogen atoms (for example, chlorine, bromine), nitro group, alkoxy groups (for example, methoxy, ethoxy, isopropoxy), aryloxy groups (for example, phenoxy), alkylthio groups (for example, methylthio, isopropylthio, tert-butylthio), arylthio groups (for example, phenylthio), amino groups (for example, amino, dimethylamino), diisopropylamino), acylamino groups (for example, acetylamino, benzoylamino), sulfonamido groups (for example, methanesulfonamido, benzenesulfonamido), cyano group, carboxyl group, alkoxycarbonyl groups (for example, methoxycarbonyl, ethoxycarbonyl), aryloxycarbonyl groups (for example, phenoxycarbonyl) and carbamoyl groups (for example, N-ethylcarbamoyl, N-phenylcarbamoyl ) .

From among these substituent groups, the alkyl groups, nitro group, alkoxy groups, alkylthio groups, amino groups, acylamino groups, sulfonamido groups, alkoxycarbonyl groups and carbamoyl groups are preferred.

The photographically useful groups represented by PUG in general formula (I) are, for example, development inhibitors, dyes, fogging agents, developing agents, couplers, bleaching accelerators or fixing accelerators. Examples of preferred photographically useful groups include those disclosed in U.S. Pat. No. 4,248,962 (those represented by the general formula PUG), the dyes disclosed in JP-A-62-49353 (the leaving group parts which are released from the coupler), the development inhibitors disclosed in U. S. Pat. No. 4,477,563 and the bleaching accelerators disclosed in JP-A-61-201247 and JP-A-2-55 (the leaving group parts which are released from the coupler). In this present invention, development inhibitors are the most desirable photographically useful groups.

The groups represented by general formulae (INH-1) to (INH-13) indicated below are preferred as development inhibitors.

(INH-1)

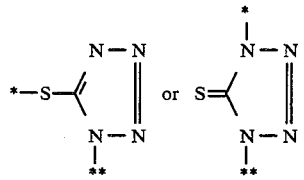

(INH-2)

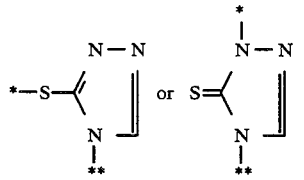

(INH-3)

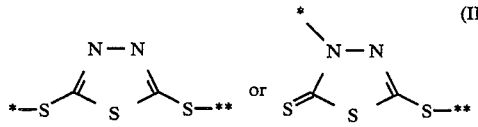

(INH-4)

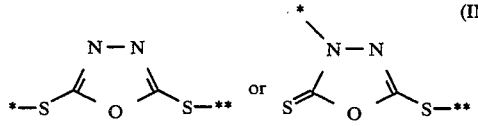

(INH-5)

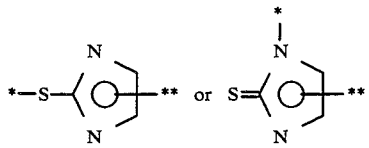

(INH-6)

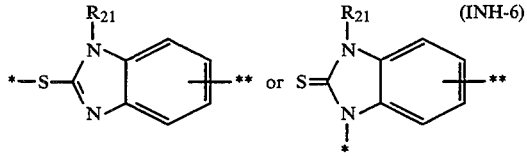

In these formulae, $R_{21}$ represents a hydrogen atom or a substituted or unsubstituted hydrocarbyl group (for example, methyl, ethyl, propyl, phenyl).

(INH-7)

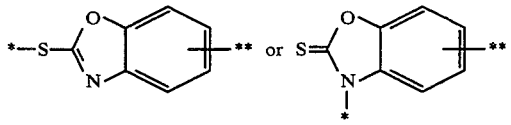

(INH-8)

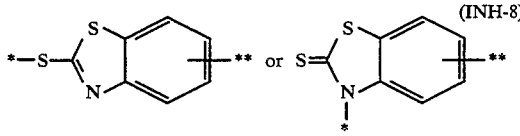

-continued (INH-9)

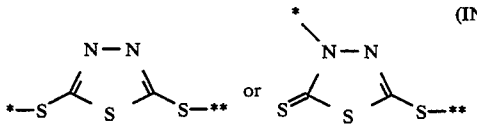

(INH-10)

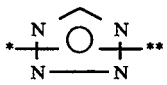

(INH-11)

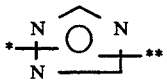

(INH-12)

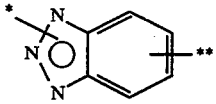

(INH-13)

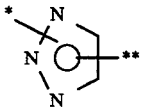

In these formulae, * indicates the position at which the group represented by $L_1$ or $L_2$ of the compound represented by general formula (I) is bonded.

Furthermore, ** indicates the position at which a substituent group is bonded, and the substituent group may be, for example, a substituted or unsubstituted alkyl group, an aryl group or a heterocyclic group. A group which is decomposed in the processing bath during photographic processing is preferably included in these substituent groups.

In practice, examples of alkyl groups attached to the ** position include methyl, ethyl, propyl, butyl, hexyl, decyl, isobutyl, tert-butyl, 2-ethylhexyl, benzyl, 4-methoxybenzyl, phenethyl, propyloxycarbonylmethyl, 2-(propyloxycarbonyl)ethyl, butyloxycarbonylmethyl, methyl, pentyloxycarbonylmethyl, 2-cyanoethyloxycarbonylmethyl, 2,2-dichloroethyloxycarbonylmethyl, 3-nitropropyloxycarbonylmethyl, 4-nitrobenzyloxycarbonylmethyl and 2,5-dioxo-3,6-dioxadecyl.

Furthermore, examples of aryl groups attached to the ** position include phenyl, naphthyl, 4-methoxycarbonylphenyl, 4-ethoxycarbonylphenyl, 3-methoxycarbonylphenyl and 4-(2-cyanoethyloxycarbonyl)phenyl Furthermore, examples of heterocyclic groups attached to the position include 4-pyridyl, 3-pyridyl, 2-pyridyl, 2-furyl and 2-tetrahydropyranyl.

From among these groups, (INH-1), (INH-2), (INH-3), (INH-4), (INH--9) and (INH-12) are preferred for INH, and (INH-1), (INH-2) and (INH-3) are especially desirable.

Actual examples of compounds of the present invention are illustrated below by illustrative Compounds (1) to (52), but the present invention is not limited to these examples.

Illustrative Compounds (1)

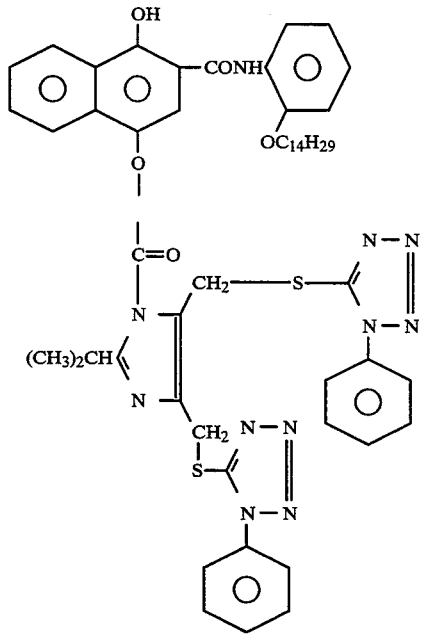

-continued
(2)
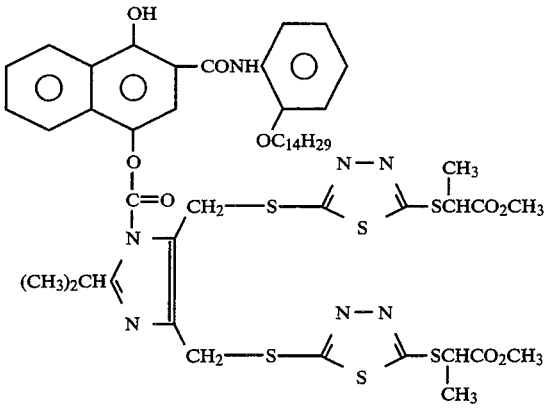
(3)
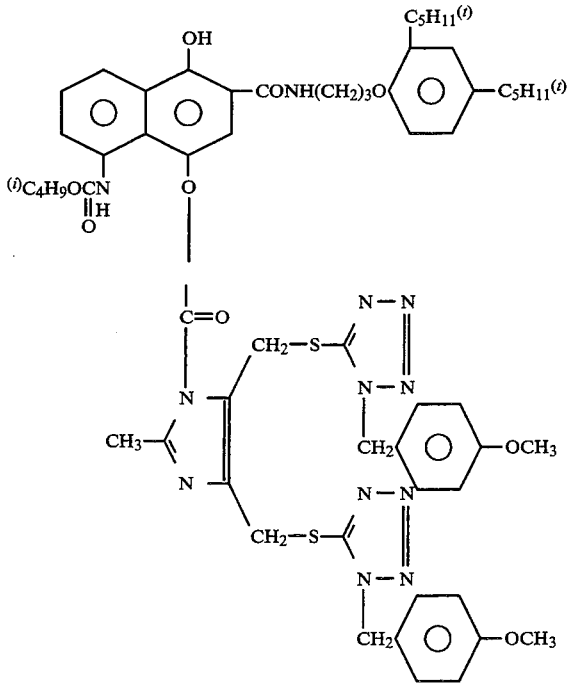
(4)
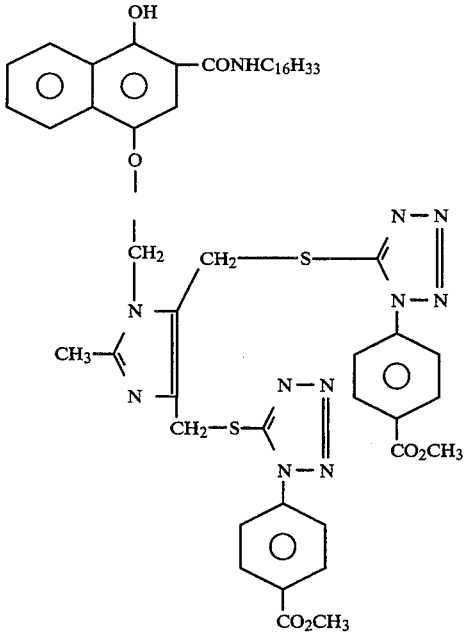

-continued
(5)
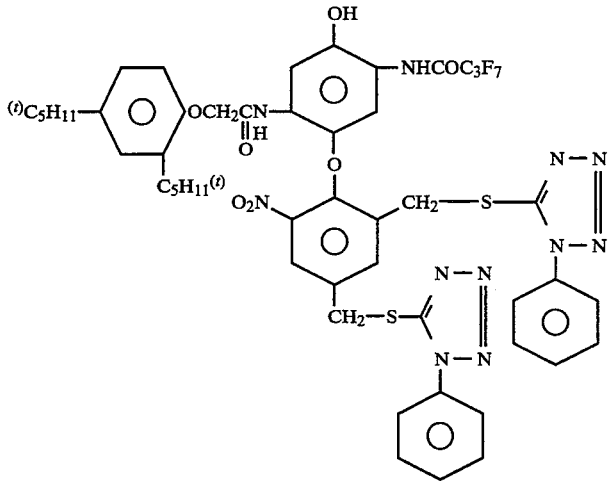
(6)
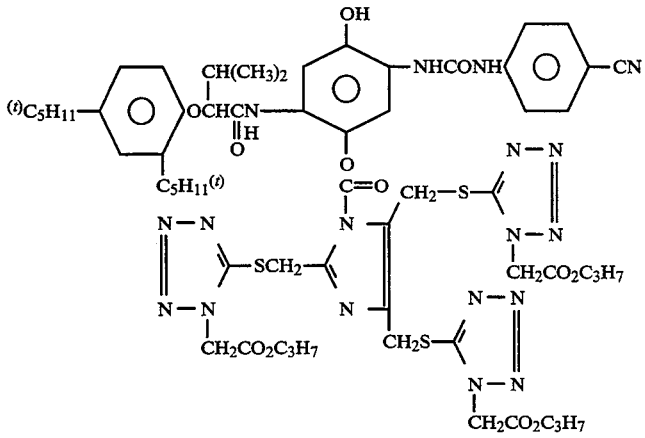
(7)
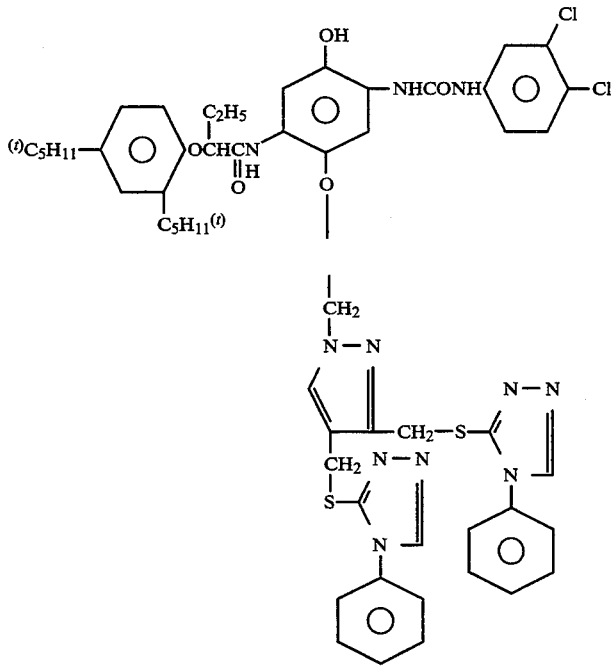

-continued
(8)
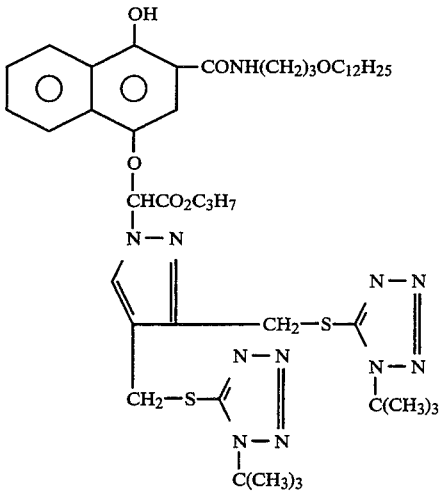
(9)
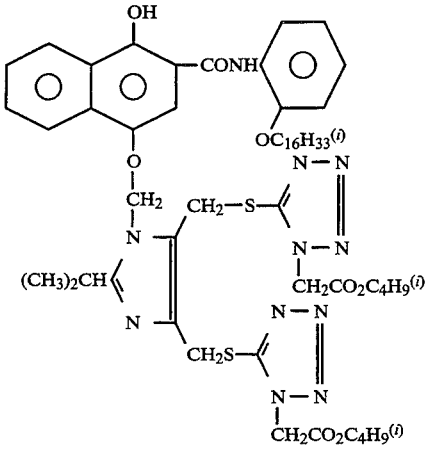
(10)
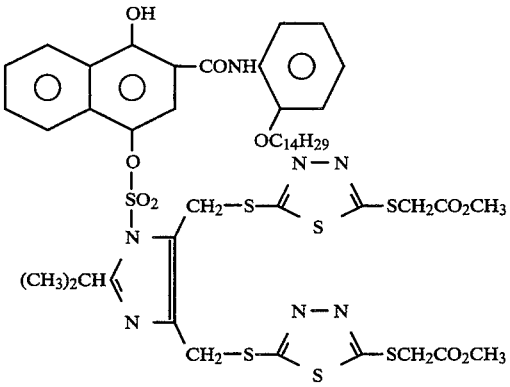

-continued
(11)
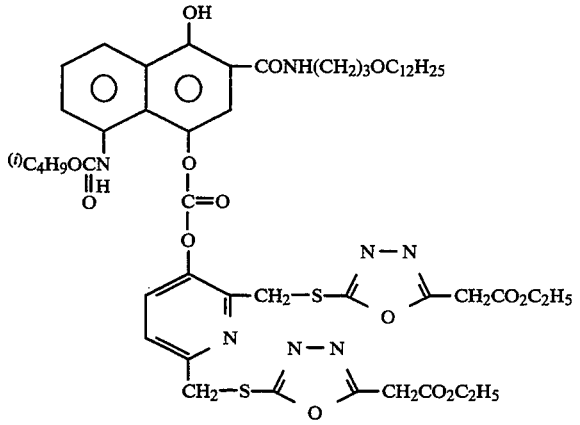
(12)
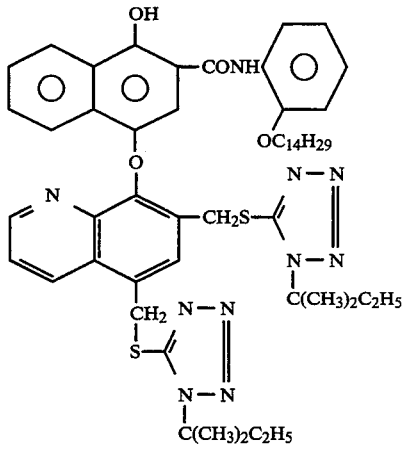
(13)
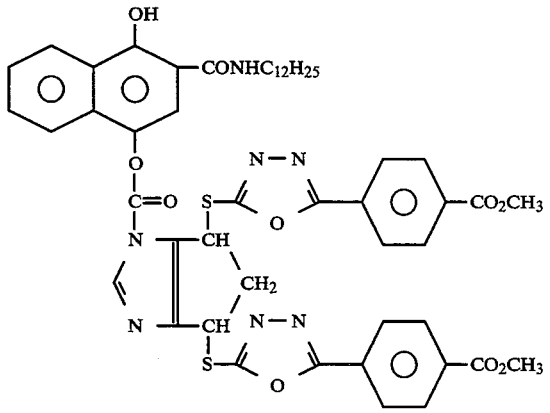
(14)
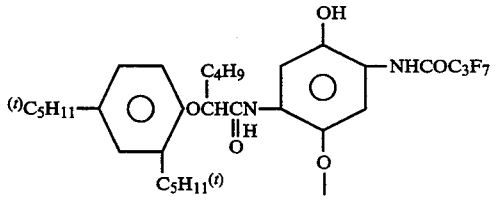

-continued
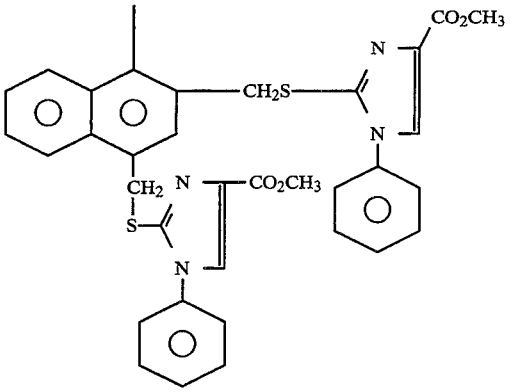
(15)
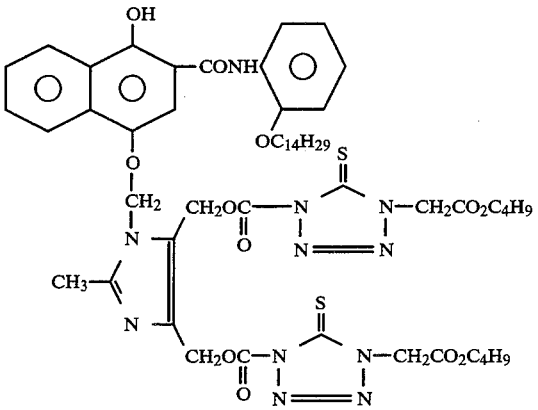
(16)
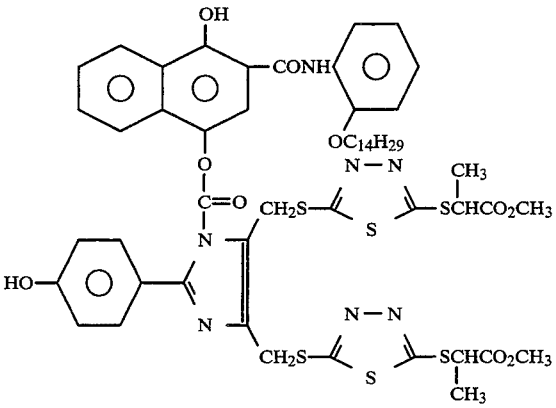
(17)
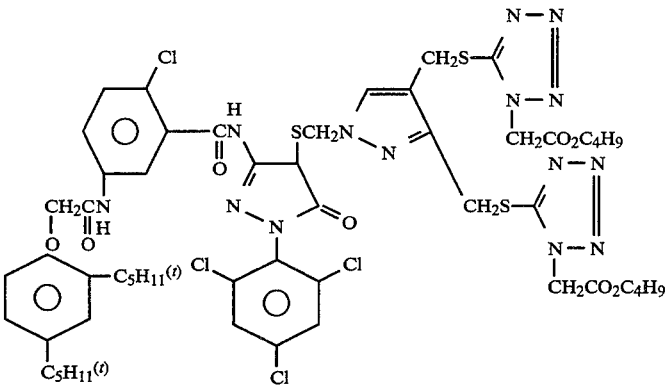

-continued
(18)
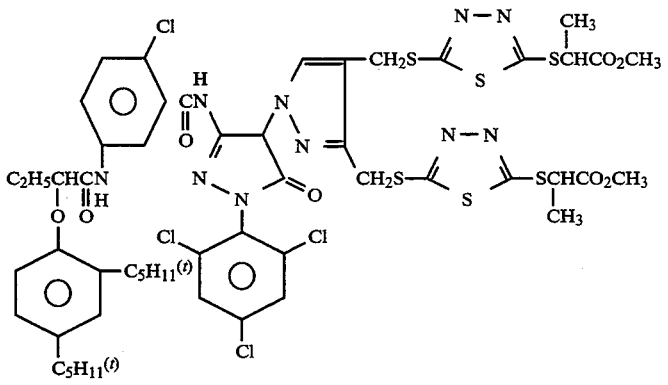
(19)
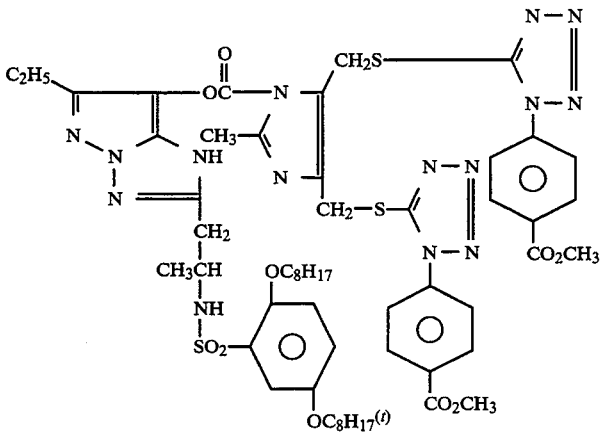
(20)
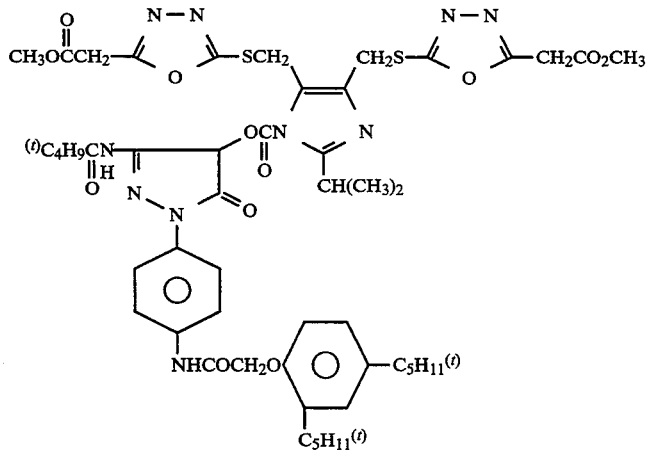
(21)
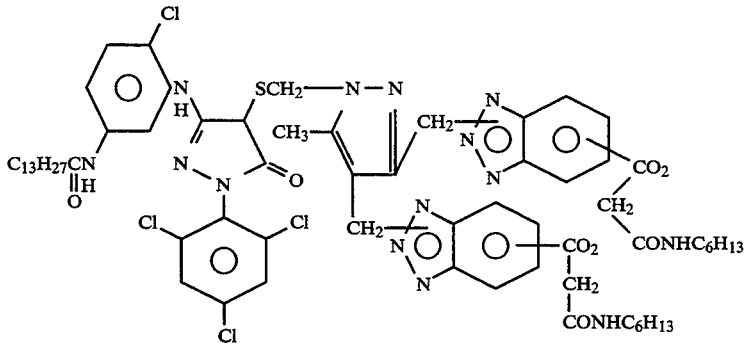

-continued
(22)
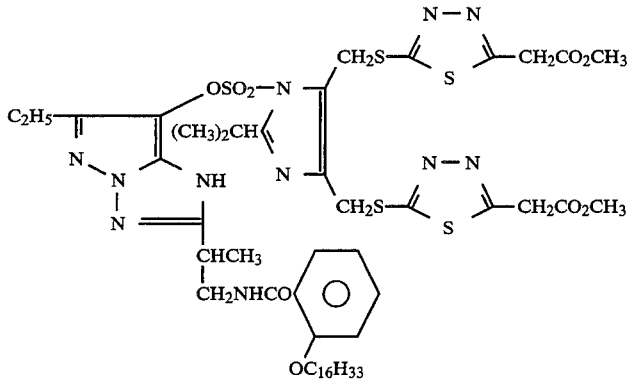
(23)
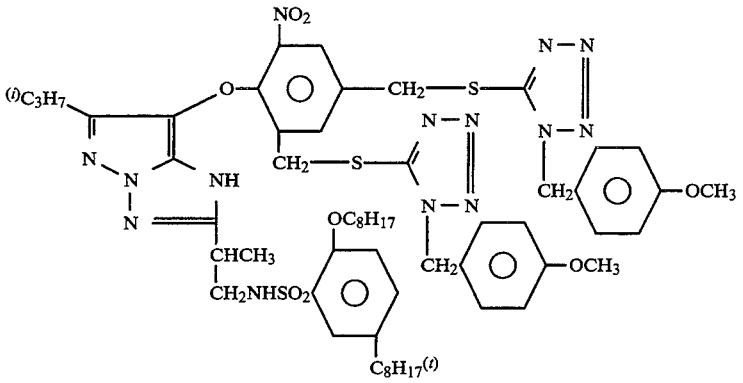
(24)
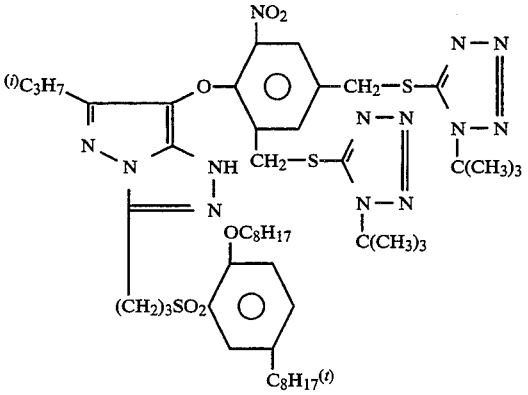
(25)
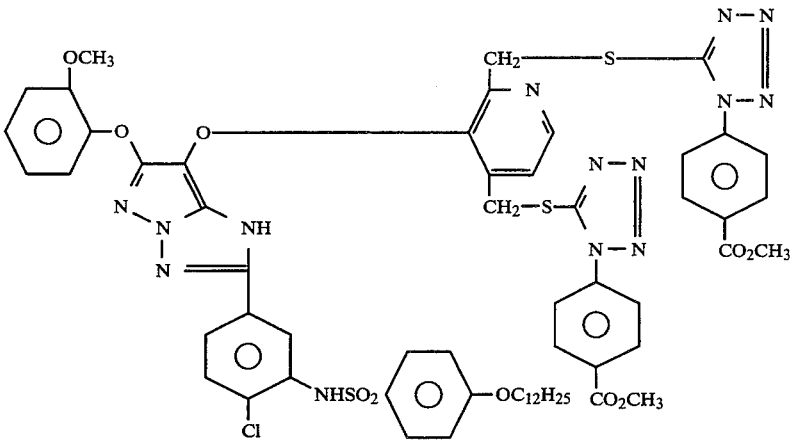

-continued
(26)
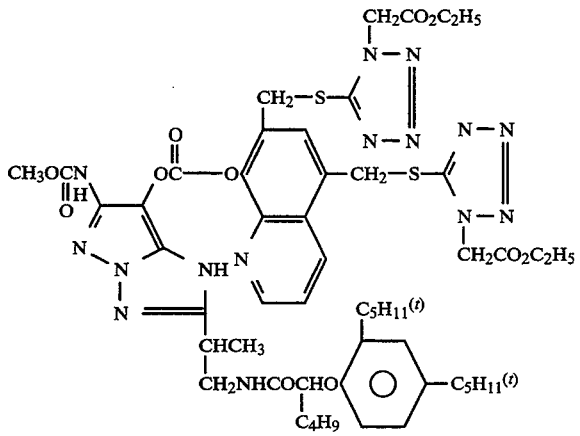
(27)
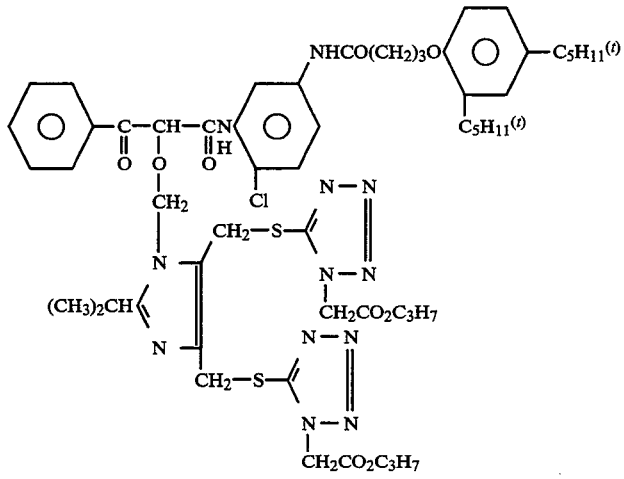
(28)
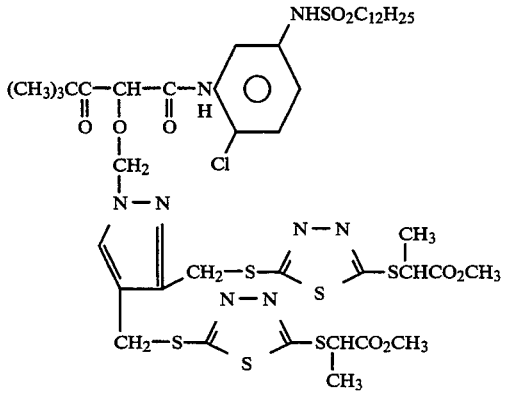
(29)
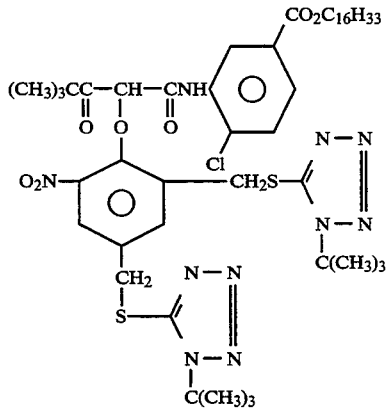

-continued
(30)
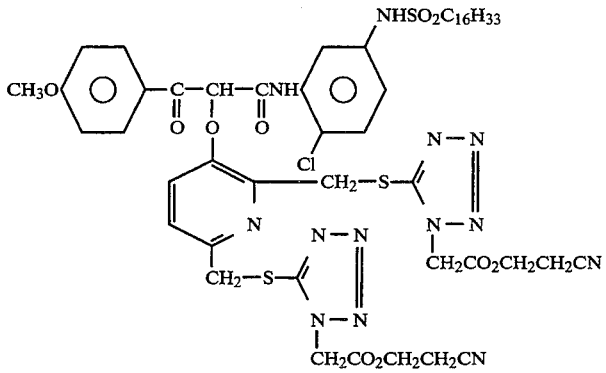
(31)
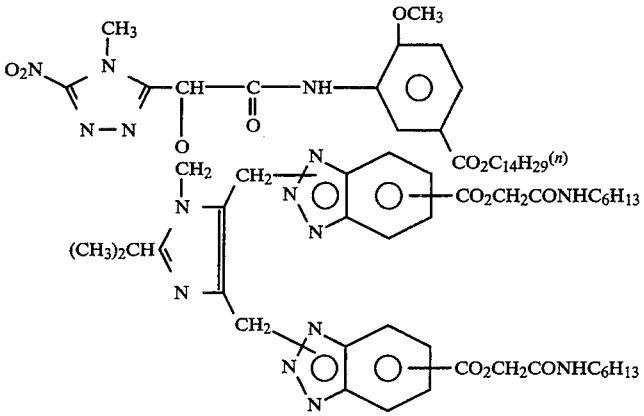
(32)
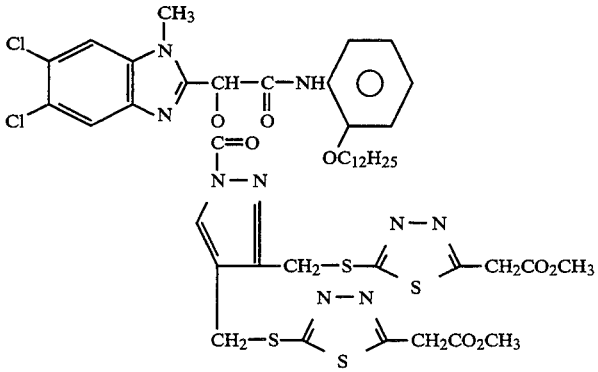
(33)
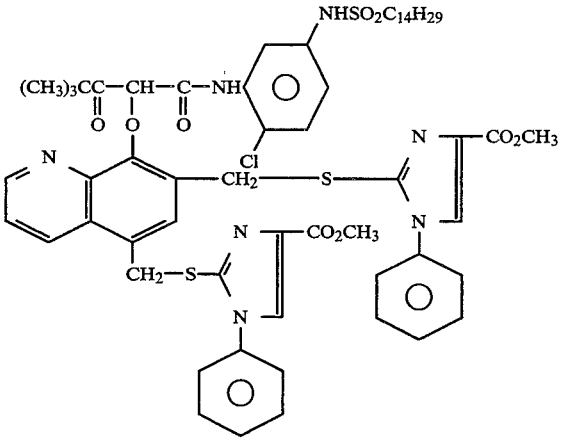

-continued
(34)
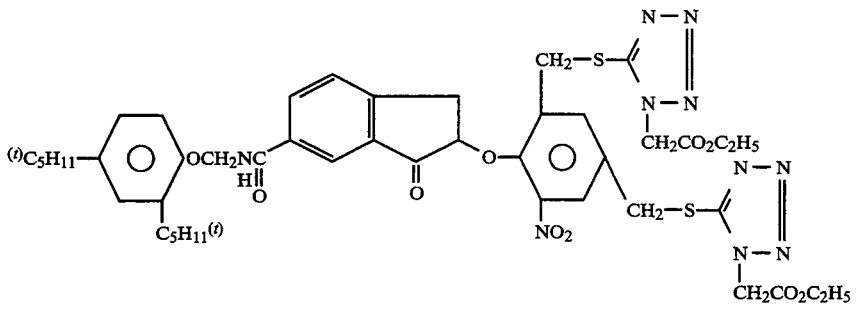
(35)
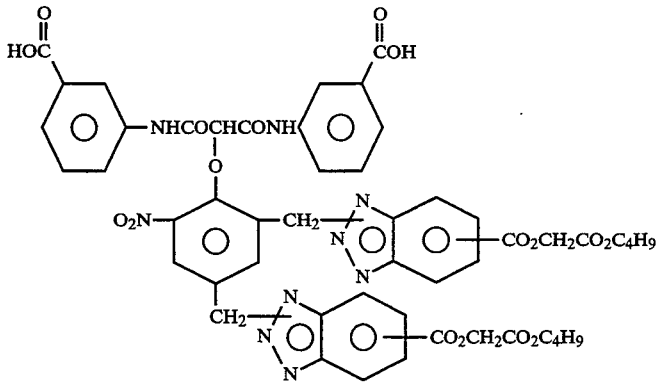
(36)
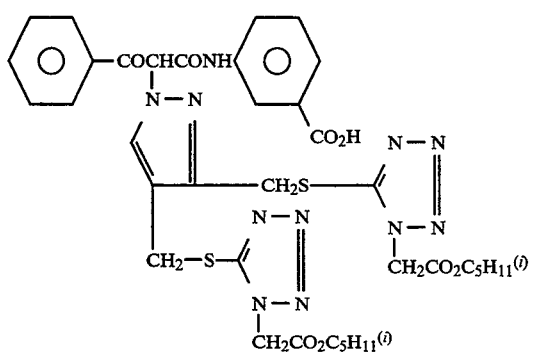
(37)
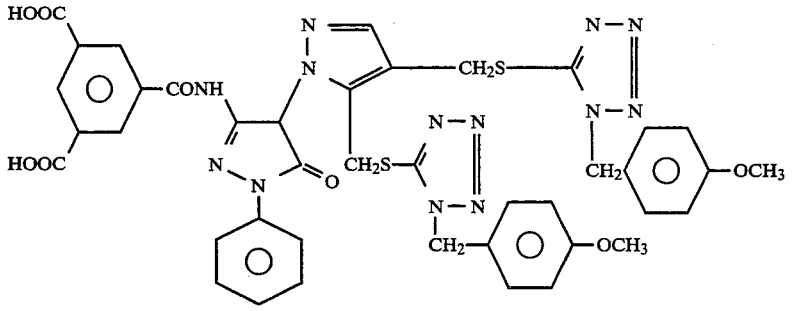
(38)
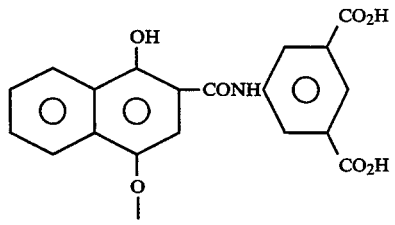

-continued
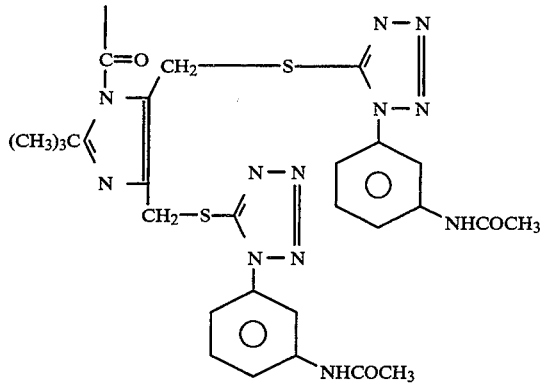
(39)
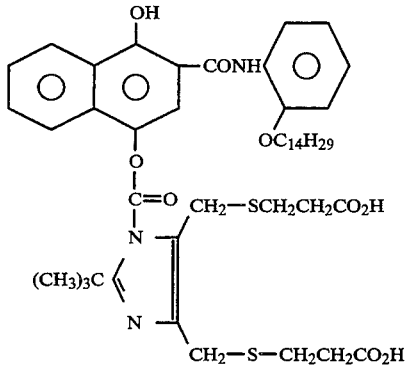
(40)
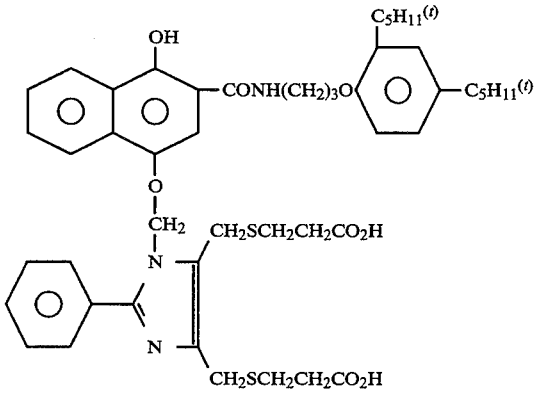
(41)
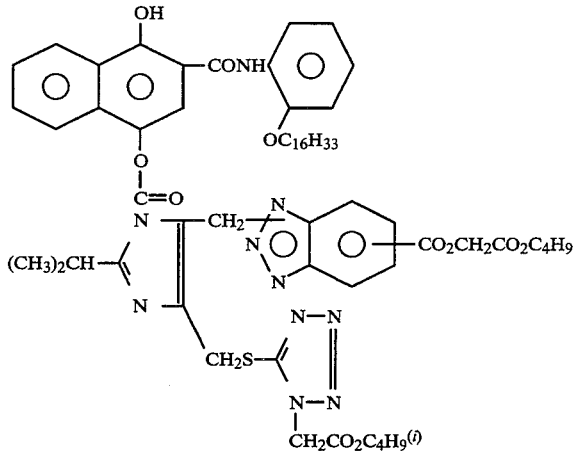

-continued
(42)
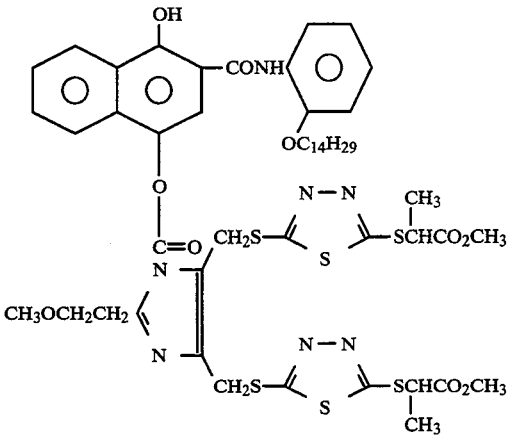
(43)
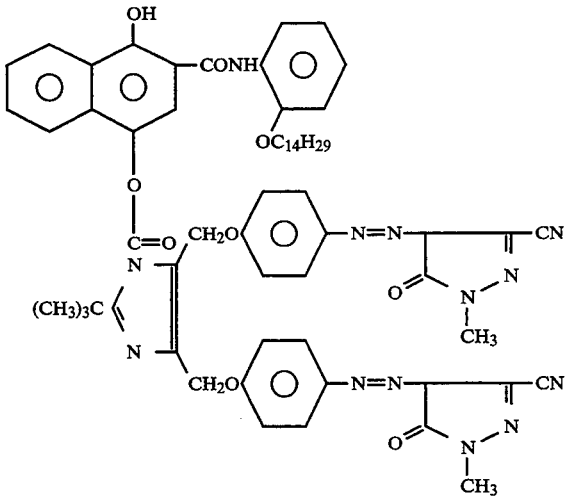
(44)
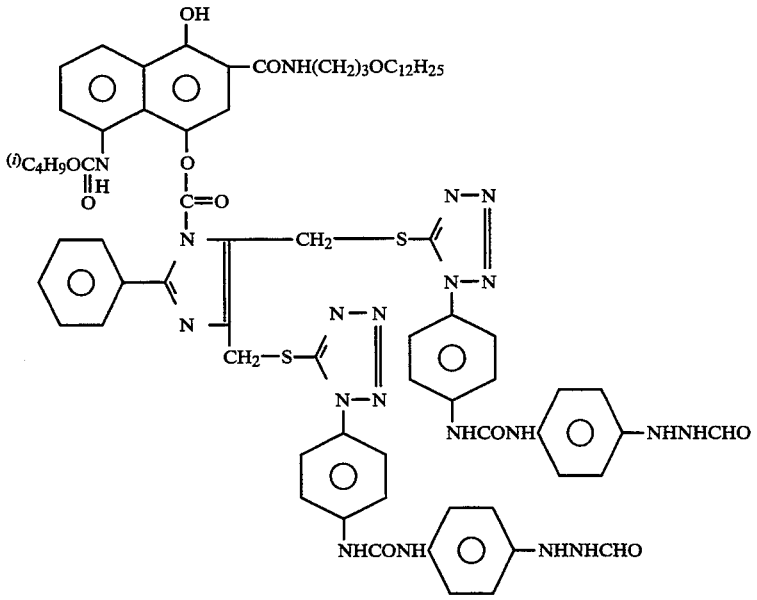

-continued
(45)
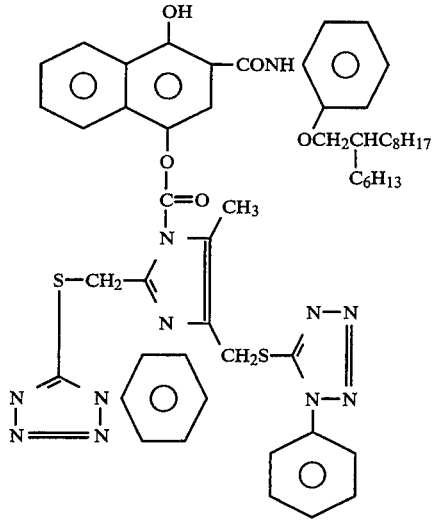
(46)
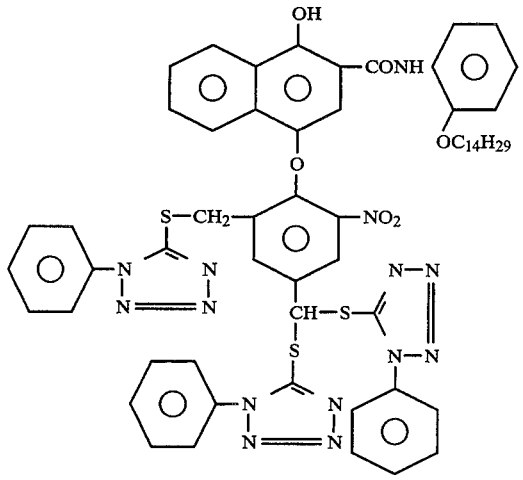
(47)
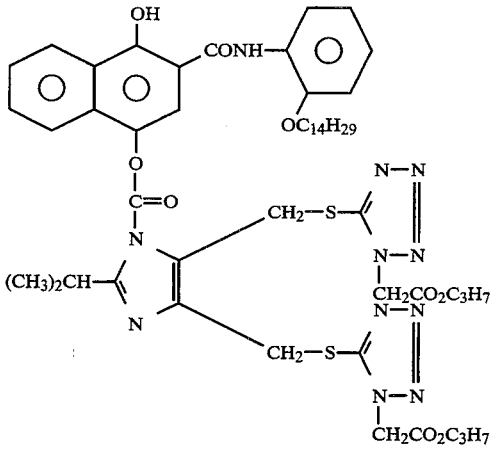

-continued
(48)
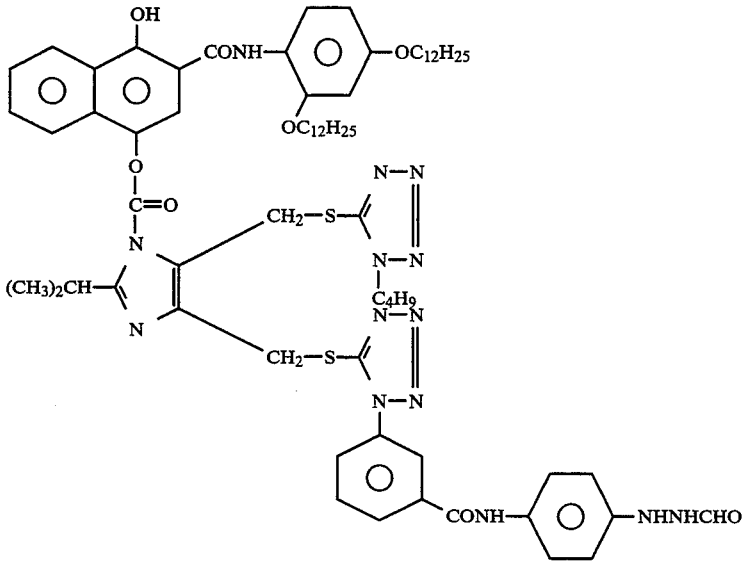
(49)
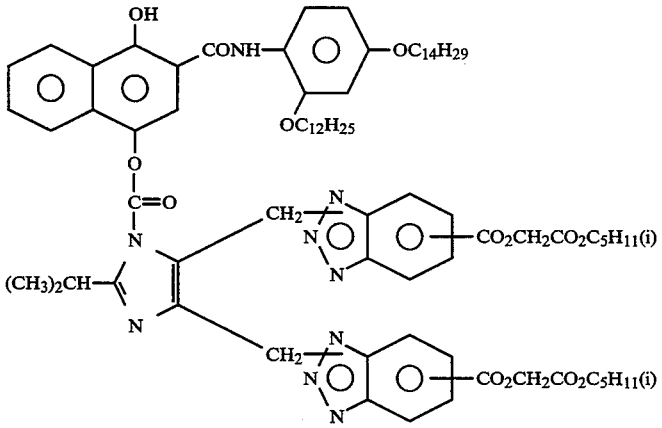
(50)
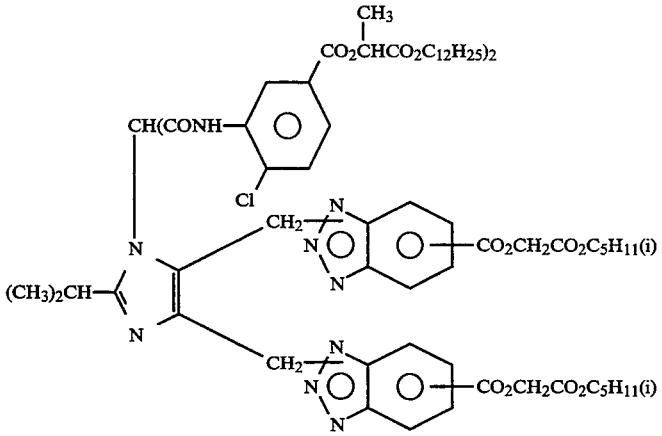

-continued (51)

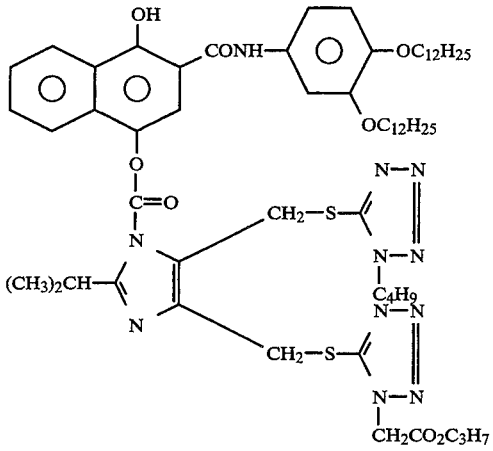

(52)

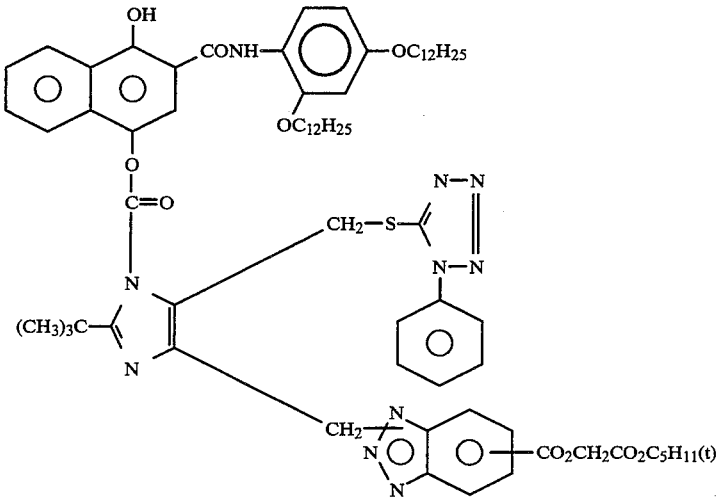

The compounds used in the present invention can be prepared using the same methods as disclosed, for example, in JP-A-60-218645 and JP-B-63-39889. (The term "JP-B" as used herein signifies an "examined Japanese patent publication".) The preparation of illustrative Compound (1) and Compound (47), described below, is a typical example of how to prepare the compounds used in the present invention.

Synthesis of Compound (1)

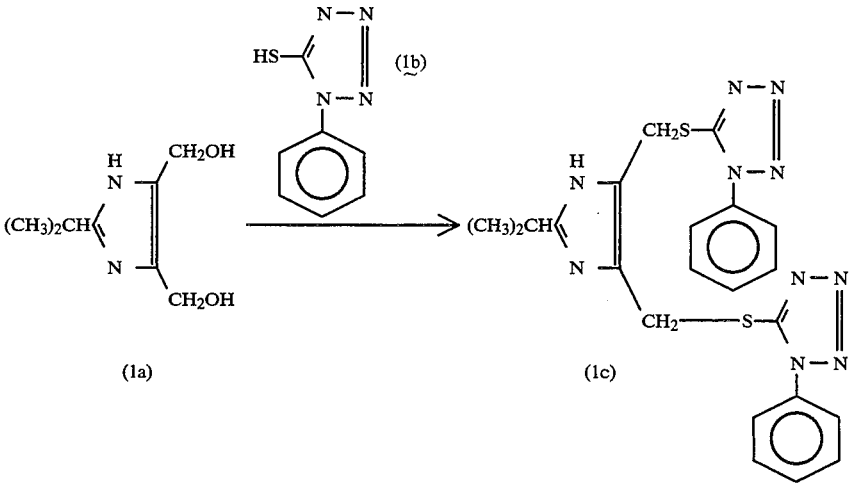

-continued

Synthesis of Compound (1)

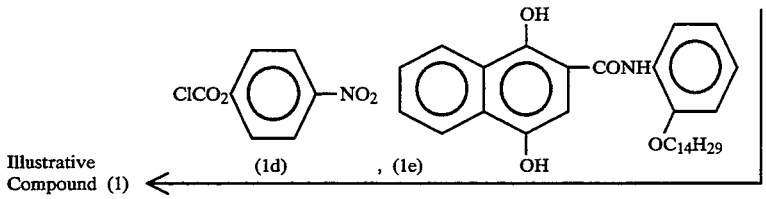

Compound (1*a*) (3.40 grams) was reacted for 1 hour at 60° C. in thionyl chloride (30 ml), and then the excess thionyl chloride was removed by distillation under reduced pressure. The residue was added to a dimethylformamide solution of Compound (1*b*) (7.84 grams) and diisopropylethylamine (10.5 ml) (0° C.) and the mixture was stirred for 1 hour. Subsequently, the solution was poured into water (500 ml), the crystals which formed were recovered by filtration and 9.8 grams of crude Compound (1*c*) crystals were obtained. The structure was confirmed using NMR.

Compound (1*c*) (3.20 grams) and Compound (1*d*) (1.38 grams) were reacted for 1 hour in 1,2-dichloroethane (30 ml). Next, an ethyl acetate (20 ml) solution of Compound (1*e*) (3.20 grams) was added with ice cooling, and then diisopropylethylamine (4.5 ml) was added, and the mixture was stirred for 1 hour.

The reaction was terminated with 1N hydrochloric acid, and the reaction mixture was diluted with the addition of chloroform (30 ml). Subsequently, the reaction mixture was washed three times with water, and then the organic layer was dried over sodium sulfate. The organic solvent was then removed by distillation, and the oily material so obtained was refined using silica gel column chromatography (ethyl acetate/hexane=1:5 by volume), and 1.20 grams of illustrative Compound (1) (mp: 132.5–135.0° C.) was obtained. The structure was confirmed by NMR.

Synthesis of Compound (47)

Compound (47) was synthesized in the same manner as in the synthesis of Compound (1), and an oily compound was obtained. The structure was confirmed by NMR.

$^1$H NMR ($CDCl_3$) (δ): 0.9 (9H), 1.1–1.45 (28H), 1.7 (6H),
3.1 (1H), 3.9–4.2 (6H), 4.55 (4H),
5.0 (4H), 6.85–7.2 (3H), 7.4 (1H),
7.5–8.1 (3H), 8.3–8.7 (3H), 13.3
(1H) ppm.

Compounds of the present invention release a plurality of PUGs during development processing. The reaction mechanism for this process is illustrated below for the case in which two molecules of PUGs are released.

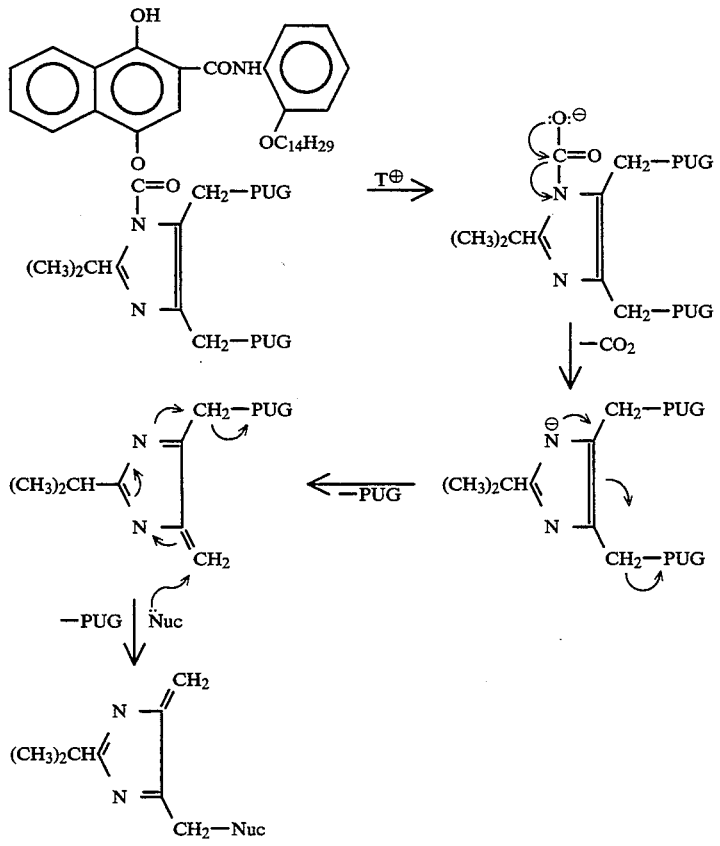

In these formulae, PUG is the same as in general formula (I). $T^+$ represents an oxidized product of a developing agent. $\ominus$Nuc represents a nucleophile which is contained in the development processing bath. In practice, this nucleophile is a hydroxyl ion, a sulfite ion or hydroxylamine, for example.

As shown by the reaction equation above, a compound of the present invention releases a plurality of PUGs from one molecule of the compound. That is to say, the compound of the present invention, in principle, doubles the action of the photographically useful group and considerably improves photographic properties.

The compounds represented by general formula (I) of the present invention may be used in any layer in the photographic material, but they are preferably used in a photographic silver halide emulsion layer or in a layer adjacent thereto, and they are most desirably added to a photosensitive silver halide emulsion layer. The amount of these compounds added to the photographic material is generally from $1\times10^{-7}$ to $5\times10^{-4}$ mol/m$^2$, preferably from $1\times10^{-6}$ to $2\times10^{-4}$ mol/m$^2$, and most desirably from $5\times10^{-6}$ to $1\times10^{-4}$ mol/m$^2$.

The compounds represented by general formula (I) of the present invention can be added in the same way as conventional couplers as described hereinafter.

A photographic material of the present invention should have on a support at least one blue sensitive silver halide emulsion layer, at least one green sensitive silver halide emulsion layer and at least one red sensitive silver halide emulsion layer. However, no particular limitation is imposed upon the number or order of the silver halide emulsion layers and non-photosensitive layers present. Typically, a silver halide photographic photosensitive material has, on a support, at least one photosensitive layer unit comprised of a plurality of silver halide emulsion layers which have essentially the same color sensitivity but different photographic speeds. The photosensitive layer unit is a photosensitive layer unit which is color sensitive to blue light, green light or red light. In a multi-layer silver halide color photographic material, the arrangement of the photosensitive layer units generally involves their placement in the order, from the support side, of a red sensitive layer unit, a green sensitive layer unit, and a blue sensitive layer unit. However, this order may be reversed, as required, and the individual layers may be arranged in such a way that a layer which has a different color sensitivity is sandwiched between layers which have the same color sensitivity.

Various non-photosensitive layers, such as intermediate layers, may be added between the above mentioned silver halide photosensitive layers, and as an uppermost layer and a lowermost layer.

The intermediate layers may contain couplers and DIR compounds, for example, such as those disclosed in the specifications of JP-A-61-43748, JP-A-59-113438, JP-A-59-113440, JP-A-61-20037 and JP-A-61-20038, and they may also contain generally used anti-color mixing compounds.

The plurality of silver halide emulsion layers constituting each photosensitive layer unit is preferably a double layer structure comprised of a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and 62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in the order, from the side furthest from the support, of blue sensitive layer/GH/RH/GL/RL as disclosed in JP-B-55-34932. In addition, the layers can also be arranged in the order, from the side furthest away from the support, of blue sensitive layer/GL/RL/GH/RH, as disclosed in the specifications of JP-A-56-25738 and JP-A-62-63936.

There are also arrangements in which there are three layers which have different speeds with the photosensitivity decreasing towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer unit of the same color sensitivity may be arranged in the order, from the side furthest from the support, of intermediate speed emulsion layer/high speed emulsion layer/low speed emulsion layer, as disclosed in the specification of JP-A-59-202464.

Additionally, the layers can be arranged in the order of high speed emulsion layer/low speed emulsion layer/intermediate speed emulsion layer, or low speed emulsion layer/intermediate speed emulsion layer/high speed emulsion layer, for example.

Furthermore, in the case where a layer unit comprises four or more layers, the layer arrangement can be chosen and altered similarly.

As described above, various layer structures and arrangements can be selected according to the purpose of the photosensitive material.

The preferred silver halides for inclusion in the photographic emulsion layers of a photographic photosensitive material of the present invention are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like (tabular) form, a form which has crystal defects such as twinned crystal planes, or a form which is a composite of these forms.

The grain size of the silver halide may be very fine with a projected area diameter of less than about 0.2 microns, or large with a projected area diameter of up to about 10 microns, and the emulsions may be polydisperse emulsions or mono-disperse emulsions.

Silver halide photographic emulsions which can be used in this present invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure,* No. 307105 (November 1989), pages 863–865, by P. Glafkides in *Chimie et Physique Photographique,* published by Paul Montel, 1967, by G. F. Duffin in *Photographic Emulsion Chemistry,* published by Focal Press, 1966, and by V. L. Zelikman et al. in *Making and Coating Photographic Emulsions,* published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, by Gutoff in *Photographic Science and Engineering,* Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type in which a latent image is formed principally on the surface of the grains, or the internal latent image type in which a latent image is formed within the grains, or of the type in which the latent image is formed both at the surface and within the grains, but in all the above cases, a negative type emulsion is necessary. From among the internal latent image types the emulsion may be a core/shell internal latent image type emulsion as disclosed in JP-A-63-264740. A method for the preparation of such a core/shell internal latent image type emulsion has been disclosed in JP-A-59-133542. The thickness of the shell of the emulsion differs, for example, according to the development processing but is preferably from 3 to 40 nm, and most desirably from 5 to 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsions which differ in terms of at least one of the characteristics of grain size, grain size distribution or halogen composition of the photosensitive silver halide emulsion, the grain form or photographic speed can be used in the form of a mixture in the same layer in a photosensitive material of this invention.

The use of essentially non-photosensitive hydrophilic colloid layers and/or photosensitive silver halide emulsion layers containing silver halide grains in which the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver is desirable. Silver halide grains in which the grain interior or surface has been fogged are silver halide grains which can be developed uniformly (not in the form of the image) irrespective of whether they are in an unexposed part or an exposed part of the photosensitive material. Methods for the preparation of silver halide grains in which the interior or surface of the grains has been fogged have been disclosed in U.S. Pat. No. 4,626,498 and JP-A-59-214852.

The silver halide which forms the internal nuclei of core/shell type silver halide grains in which the interior has been fogged may have the same halogen composition or a different halogen composition. The silver halide in which the interior or surface of the grains has been fogged may be silver chloride, silver chlorobromide, silver iodobromide or silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains, and they may be regular grains, and they may be poly-disperse emulsions, but mono-disperse emulsions (in which at least 95% in terms of the weight or number of silver halide grains have a grain size within ±40% of the average grain size) are preferred.

The use of non-photosensitive fine grained silver halides is desirable in the present invention. Non-photosensitive fine grained silver halides are fine grained silver halides which are not photosensitive at the time of the imagewise exposure for obtaining the dye image and which undergo essentially no development during development processing, and those which have not been pre-fogged are preferred.

The fine grained silver halide has a silver bromide content from 0 to 100 mol % and may contain silver chloride and/or silver iodide as required. Those which have a silver iodide content of from 0.5 to 10 mol % are preferred.

The fine grained silver halide has an average grain size (the average value of the diameters of the circles corresponding to the projected areas) preferably of from 0.01 to 0.5 μm, and most desirably of from 0.02 to 0.2 μm.

The fine grained silver halide can be prepared using the same methods as used in general for the preparation of photosensitive silver halides. In this case, the surface of the silver halide grains does not to be optically sensitized nor spectrally sensitized. However, the pre-addition of known stabilizers such as triazole, azaindene, benzothiazolium or mercapto based compounds or zinc compounds before addition to the coating liquid is desirable. Colloidal silver can also be included desirably in the layer which contains these fine grained silver halide grains.

The coated weight of silver in a photographic material of the present invention is preferably not more than 6.0 g/m$^2$, and most desirably not more than 4.5 g/m$^2$.

Known photographically useful additives which can be used in-the present invention have been disclosed in the three *Research Disclosures* referred to above, and the locations of these disclosures are also indicated in the table below.

| Type of Additive | RD17643 (December 1978) | RD18716 (November 1979) | RD307105 (November 1989) |
|---|---|---|---|
| 1. Chemical sensitizers | Page 23 | Page 648, right hand column | Page 866 |
| 2. Accelerating agents | | Page 648, right hand column | |
| 3. Spectral sensitizers, Super-Sensitizers | Pages 23–24 | Page 648 right hand column–page 649 right hand column | Pages 866–868 |
| 4. Brightening agents | Page 24 | Page 647, right hand column | Page 868 |
| 5. Anti-foggants, stabilizers | Pages 24–25 | Page 649, right hand column | Pages 868–870 |
| 6. Light absorbers, Filter dyes and Ultraviolet absorbers | Pages 25–26 | Page 649, right hand column–page 650, left hand column | Page 873 |
| 7. Anti-staining agents | Page 25, right hand column | Page 650, left hand column–right hand column | Page 872 |
| 8. Dye image stabilizers | Page 25 | page 650, left hand column | Page 872 |
| 9. Film hardening agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating aids, Surfactants | Pages 26–27 | Page 650, right hand column | Pages 875–876 |
| 13. Anti-static agents | Page 27 | Page 650, right hand column | Pages 876–877 |
| 14. Matting agents | | | Pages 878–879 |

Furthermore, addition to the photographic material of compounds which can react with and fix formaldehyde, as disclosed, for example, in U.S. Pat. Nos. 4,411,987 and 4,435,503, is desirable for preventing deterioration of photographic performance due to formaldehyde gas.

The inclusion of the mercapto compounds disclosed in U.S. Pat. Nos. 4,740,454 and 4,788,132, JP-A-62-18539 and JP-A-1-283551 in the photographic material of the present invention is desirable.

The inclusion of compounds which release fogging agents, development accelerators, silver halide solvents or precursors of these materials irrespective of the amount of developed silver produced by development processing disclosed in JP-A-1-106052 is desirable in the photographic material of the present invention.

The inclusion of dyes dispersed using the methods disclosed in International Patent laid open WO88/04794 and JP-A-1-502912, and the dyes disclosed in EP 317,308A, U.S. Pat. No. 4,420,555 and JP-A-1-259358 in the photographic material of the present invention is desirable.

Various color couplers can be used in the present invention, and actual examples have been disclosed in the patents cited in the aforementioned *Research Disclosure* No. 17643, sections VII-C–G, and No. 307105, sections VII-C–G.

As yellow couplers, these disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO 88/04795 are especially desirable.

Phenol based and naphthol based couplers can be used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Moreover, the pyrazoloazole based couplers disclosed in JP-A--64-553, JP-A-64-554, JP-A-64-555 and JP-A-64-556, and the imidazole based couplers disclosed in U.S. Pat. No. 4,818,672, can also be used.

Typical examples of polymerized dye forming couplers have been disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Patent 4,366,237, British Patent 2,125,570, European Patent 96,570 and West German Patent (Laid Open) 3,234,533 are preferred as couplers in which the colored dyes have a suitable degree of diffusibility.

Colored couplers for correcting unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are preferred. Furthermore, the use of couplers which correct unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 are also desirable.

The use of compounds which release photographically useful residual groups on coupling is also desirable in the present invention. The DIR couplers which release development inhibitors disclosed in the patents cited in section VII-F of the aforementioned *Research Disclosure* 17643 and section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012, as well as those represented by general formula (I) of the present invention, are preferred.

The couplers disclosed in British Patents 2,097,140 and 2,131,188, JP-A-59-157638 and JP-A-59-170840 are preferred as couplers which release nucleating agents or development accelerators in the form of the image during development. Furthermore, the compounds which release fogging agents, development accelerators, silver halide solvents etc. by means of a redox reaction with an oxidized product of a developing agent disclosed in JP-A-60-107029, JP-A-60-252340, JP-A-1-44940 and JP-A-1-45687 are also desirable.

Other compounds which can be used in the photographic materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes in which the color is restored after elimination disclosed in European Patents 173,302A and 313,308A, the bleach accelerator releasing couplers disclosed, for example, in *Research Disclosure* Nos. 11449 and 24241, and JP-A-61-201247, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the photographic material using a variety of known methods, such as an oil-in-water dispersion method or a loadable latex dispersion method.

Examples of high boiling point solvents which can be used in the oil-in-water dispersion method have been disclosed, for example, in U.S. Pat. No. 2,322,027.

Actual examples of high boiling point organic solvents which have a boiling point of at least 175° C. at normal pressure which can be used in the oil-in-water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl-)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and diisopropylnaphthalene).

Further, organic solvents which have a boiling point above about 30° C., and preferably of at least 50° C., but below about 160° C. can be used as auxiliary solvents. Typical examples of these auxiliary solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes have been disclosed, for example, in U.S. Pat. No. 4,199,363, and in West German Patent Applications (OLS) 2,541,274 and 2,541,230.

The addition to the color photographic material of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole, for example, as disclosed in JP-A-63-257747, JP-A-62-272248 and JP-A-1-80941, is desirable.

The present invention can be applied to various types of color photographic material. Typical examples include color negative films for general and cinematographic purposes, color reversal films for slides and television, color papers, color positive films and color reversal papers.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105.

The photographic material of the present invention are such that the total film thickness of all the hydrophilic colloid layers on the side where the emulsion layers are located is preferably not more than 28 μm, more preferably not more than 23 μm, even more preferably not more than 18 μm, and most preferably not more than 16 μm. Further, the film swelling rate $T_{\frac{1}{2}}$ is preferably not more than 30 seconds and most desirably not more than 20 seconds. The film thickness signifies the film thickness measured under conditions of 25° C., 55% relative humidity (2 days) and the film swelling rate $T_{\frac{1}{2}}$ is measured using methods well known to those in the industry. For example, measurements can be made using a swellometer of the type described by A. Green in *Photogr. Sci. Eng.*, Volume 19, Number 2, pages 124–129, the saturated film thickness, taking 90% of the maximum swelled film thickness reached on processing the material for 3 minutes 15 seconds in a color developer at 30° C. as the saturated film thickness.

The film swelling rate $T_{\frac{1}{2}}$ can be adjusted by adding film hardening agents for the gelatin which is used as a binder, or by changing the ageing conditions after coating. A swelling factor of the photographic material of from 150% to 400% is preferred, swelling factor can be calculated from the maximum swelled film thickness obtained under the conditions described above using the expression (maximum swelled film thickness minus film thickness)/film thickness.

The establishment of a hydrophilic colloid layer, known as a backing layer, of total dry film thickness from 2 μm to 20 μm on the opposite side from the emulsion layers is desirable in the photographic material of the present invention. The inclusion in the backing layer of light absorbing agents, filter dyes, ultraviolet absorbers, anti-static agents, film hardening agents, binders, plasticizers, lubricants, coating aids and surfactants, for example, as described above is desirable. The swelling factor of the backing layer is preferably from 150% to 500%.

Color photographic materials used in the present invention can be developed and processed using the general methods disclosed on pages 28–29 of the aforementioned *Research Disclosure* No. 17643, from the left hand column to the right hand column of page 651 of the aforementioned *Research Disclosure* No. 18716, and on pages 880 to 881 of *Research Disclosure* No. 307105.

The color developers used for the development processing of photographic materials of the present invention are preferably aqueous alkaline solutions which contain a primary aromatic amine based color developing agent as the principal component. Amino-phenol based compounds are also useful as color developing agents, but the use of p-phenylenediamine based compounds is preferred and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone, and aminophenols such as N-methyl-p-aminophenol, for example, can be used individually, or in combinations, in the black and white developer.

The pH of these color developers and black and white developers is generally from 9 to 12. The replenishment rate for these developers depends on the color photographic photosensitive material which is being processed, but in general, it is not more than 3 liters per square meter of photographic material, and it can be set to not more than 500 ml by reducing the bromide ion concentration in the replenisher. In those cases where the replenishment rate is low it is desirable that evaporation and aerial oxidation of the liquid should be prevented by minimizing the area of contact with air in the processing tank.

The contact area between the air and the photographic processing bath in a processing tank can be represented by the opening ratio which is defined below. Thus:

$$\text{Opening Ratio} = \frac{\text{Contact Area of Processing Bath with Air (cm}^2\text{)}}{\text{Processing Bath Volume (cm}^3\text{)}}$$

The above mentioned opening ratio is preferably not more than 0.1, and most desirably from 0.001 to 0.05. In addition to the establishment of a shielding material such as a floating lid, for example, on the surface of the photographic processing bath in the processing tank, the method involving the use of a movable lid as disclosed in JP-A-1-82033 and the method involving slit development processing disclosed in JP-A-63-216050 can be used as means of reducing the opening ratio. Reduction of the opening ratio is preferably applied not only to the processes of color development and black and white development but also to all the subsequent processes, such as bleaching, bleach-fixing, fixing, water washing and stabilizing.

The replenishment rate can be reduced by using a means to suppress the accumulation of bromide ion in the development bath.

The color development processing time is generally between 2 and 5 minutes, but shorter processing times can be employed by increasing the temperature and the pH and moreover increasing the concentration of the color developing agent.

The photographic emulsion layer is generally subjected to a bleaching process after color development. The bleaching process may be carried out at the same time as a fixing process (in a bleach-fix process), or it may be carried out separately. Moreover, a bleach-fix process can be carried out after a bleaching process in order to speed up processing. Moreover, processing can be carried out in two series-connected bleach-fix baths, a fixing process can be carried out before a bleach-fixing process or a bleaching process can be carried out after a bleach-fix process, as required. Compounds of multivalent metals, such as iron(III) for example, peracids, quinones and nitro compounds for example can be used as bleaching agents. Typical bleaching agents include organic complex salts of iron(III), for example, complex salts with aminopolycarboxylic acids such as ethylenediaminetetraacetic acid, diethylenetriaminepentaacetic acid, cyclohexanediaminetetraacetic acid, methylimino diacetic acid, 1,3-diaminopropane tetra-acetic acid and glycol ether diamine tetra-acetic acid, or citric acid, tartaric acid or malic acid, for example. From among these materials, the use of aminopolycarboxylic acid iron(III) complex salts, and principally of ethylenediamine tetra-acetic acid iron(III) complex salts and 1,3-diaminopropane tetra-acetic acid iron(III) salts, is preferred for rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix pre-baths. Actual examples of useful bleach accelerators include compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (June 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-250 95630 bath and are especially desirable. Morever, the compounds disclosed in U.S. Pat. No. 4,552,834 are also desirable. These bleaching accelerators may be added to the photographic materials. These bleaching accelerators are especially effective when bleach-fixing camera color photographic materials.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acids, and in practice, acetic acid and propionic acid, for example, are preferred.

Thiosulfate, thiocyanate, thioether based compounds, thioureas and large amounts of iodide can be used, for example, as the fixing agent which is used in a fixing bath or bleach-fixing bath, but thiosulfate is generally used, and ammonium thiosulfate in particular can be used in the widest range of applications. Further, the combination use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fixing baths. Moreover, the addition of various aminopolycarboxylic acids and organophosphonic acids to the fixing baths and bleach-fixing baths is desirable for stabilizing these baths.

The addition of compounds of pKa from 6.0 to 9.0, and preferably imidazoles such as imidazole, 1-methylimidazole, 1-ethylimidazole and 2-methylimidazole, in amounts of from 0.1 to 10 mol/liter to the fixing bath or bleach-fixing bath is desirable in the present invention.

A shorter total de-silvering (bleach-fixing and fixing) processing time within the range where de-silvering failure does not occur is preferred. The de-silvering time is preferably from 1 to 3 minutes, and most desirably from 1 to 2 minutes. The processing temperature is from 25° C. to 50° C., and preferably from 35° C. to 45° C. The de-silvering rate is increased, and the occurrence of staining after processing is effectively prevented within the preferred temperature range.

As much agitation as possible is desirable during the de-silvering process. Actual examples of methods of strong agitation include the methods in which a jet of processing liquid contacts the emulsion surface of the photographic material as disclosed in JP-A-62-183460, the method in which the agitation effect is increased using a rotary device as disclosed in JP-A-62-183461, the method in which the photographic material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which may be used for processing photographic materials of the present invention preferably have photographic material transporting devices as disclosed in JP-A-60-191257, JP-A-60-191258 or JP-A-60-191259. With such a transporting device, such as that disclosed in the aforementioned JP-A-60-191257, the carry-over of processing liquid from one bath to the next is greatly reduced, and this is very effective for preventing deterioration in processing bath performance. These effects are especially useful for shortening the processing time in each process and for reducing the replenishment rate of each processing bath.

The silver halide color photographic materials of the present invention are generally subjected to a water washing process and/or stabilizing process after the de-silvering process. The amount of wash water used in the washing process can be within a wide range, depending on the application and the nature (for example, depending on the materials, such as couplers, which have been used) of the photographic material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers,* Volume 64 (May 1955).

The amount of wash water used can be greatly reduced by using the multi-stage counter-flow system noted in the aforementioned literature, but bacteria proliferate due to the increased residence time of the water in the tanks, and problems arise when the suspended matter produced becomes attached to the photographic material. The method in which the calcium ion and magnesium ion concentrations are reduced, as disclosed in JP-A-62-288838, is very effective as a means of overcoming this problem when processing color photographic materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, (1986, Sanko Shuppan), in *Killing Micro-organisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water when processing photosensitive materials of this invention is from 4 to 9, and preferably from 5 to 8. The washing water temperature and the washing time can be varied in accordance with the nature and application of the photosensitive material, but in general, washing conditions of from 20 seconds to 10 minutes at a temperature of from 15° C. to 45° C., and preferably from 30 seconds to 5 minutes at a temperature from 25° C. to 40° C., are selected. Moreover, the photographic materials of the present invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process, and the stabilizing baths which contain dye stabilizing agents and surfactants which are used as final baths with camera color photographic materials are an example of such a process. Aldehydes such as formalin and glutaraldehyde, N-methylol compounds, hexamethylenetetramine and aldehyde/bisulfite adducts can be used, for example, as dye stabilizing agents.

Various chelating agents and fungicides can also be added to these stabilizing baths.

The overflow which accompanies replenishment of the above mentioned water washing or stabilizing baths can be reused in other processes, such as the de-silvering process for example.

Concentration correction with the addition of water is desirable in cases where the above mentioned processing baths become concentrated due to evaporation when processing in an automatic processor for example.

Color developing agents can be incorporated into a silver halide color photosensitive material of the present invention to simplify and speed up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599, *Research Disclosure* No. 14850 and *Research Disclosure* No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as required, into a silver halide color photographic material of the present invention to accelerate color development. Typical compounds have been disclosed, for example, in JP-A-56-64339, JP-A-57-144547 and JP-A-58-115438.

The various processing baths used with the present invention are used at a temperature of from 10° C. to 50° C. The standard temperature is generally from 33° C. to 38° C., but accelerated processing and shorter processing times can be employed at higher temperatures. On the other hand, increased picture quality and improved processing bath stability can be achieved at lower temperatures.

Furthermore, the silver halide photographic materials of the present invention can also be used as the heat developable photosensitive materials disclosed, for example, in U.S. Pat. No. 4,500,626, JP-A-60-133449, JP-A-59-218443, JP-A-61-238056 and European Patent 10,660A2.

ILLUSTRATIVE EXAMPLES

The invention is described in detail below by means of illustrative examples, but it is not limited by these examples.

EXAMPLE 1

Sample 101, a multi-layer color photosensitive material comprised of the layers described below, was prepared on a cellulose triacetate film support on which a subbing layer had been established.

Composition of the Photosensitive Layer

Coated weights are shown in units of grams/m$^2$ as silver in the case of silver halides and colloidal silver, in units of g/m$^2$ in the case of couplers, additives and gelatin, and in units of mol per mol of silver halide in the same layer in the case of the sensitizing dyes. The codes used for the compounds have the significance indicated below. However, in those cases where a compound has several effects it is listed under just one of these effects. UV: Ultraviolet absorber, Solv: High boiling point organic solvent, ExF: Dye, ExS: Sensitizing dye, ExC: Cyan coupler, ExM: Magenta coupler, ExY: Yellow coupler, Cpd: Compound.

| | |
|---|---|
| First Layer Anti-halation Layer | |
| Black colloidal silver | 0.15 as silver |
| Gelatin | 1.90 |
| ExM-8 | $2.0 \times 10^{-2}$ |
| Second Layer Intermediate Layer | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| Third Layer Low Speed Red Sensitive Emulsion Layer | |
| Silver iodobromide emulsion (AgI 2 mol %, internal high AgI type, corresponding sphere diameter* 0.25 μm, variation coefficient of corresponding sphere diameter 15%, regular crystal grain/twinned crystal grain mixture, diameter/thickness ratio 1.2) | 0.50 as silver |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.22 |
| ExC-4 | $3.0 \times 10^{-3}$ |

-continued

| | |
|---|---|
| Solv-1 | $0.15 \times 10^{-3}$ |
| Fourth Layer (Intermediate Speed Red Sensitive Emulsion Layer) | |
| Silver iodobromide emulsion (AgI 4 mol %, internal high AgI type, corresponding sphere diameter 0.55 μm, variation coefficient of corresponding sphere diameter 18%, regular crystal grain/twinned crystal grain mixture, diameter/ thickness ratio 1.0) | 0.85 as silver |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-2 | $8.0 \times 10^{-2}$ |
| ExC-3 | 0.33 |
| ExY-13 | $2.0 \times 10^{-2}$ |
| ExY-14 | $1.0 \times 10^{-2}$ |
| Cpd-10 | $1.0 \times 10^{-4}$ |
| Solv-1 | 0.10 |
| Fifth Layer (High Speed Red Sensitive Emulsion Layer) | |
| Silver iodobromide emulsion (AgI 10 mol %, internal high AgI type, corresponding sphere diameter 0.60 μm, variation coefficient of corresponding sphere diameter 20%, regular crystal grain/twinned crystal grain mixture, diameter/ thickness ratio 5.5) | 0.70 as silver |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| Solv-1 | 0.15 |
| Solv-2 | $8.0 \times 10^{-2}$ |
| Sixth Layer (Intermediate Layer) | |
| Gelatin | 1.10 |
| P-2 | 0.17 |
| Cpd-1 | 0.10 |
| Cpd-4 | 0.17 |
| Solv-1 | $5.0 \times 10^{-2}$ |
| Seventh Layer (Low Speed Green Sensitive Emulsion Layer) | |
| Silver iodobromide emulsion (AgI 2 mol %, internal high AgI type, corresponding sphere diameter 0.3 μm, variation coefficient of corresponding sphere diameter 28%, regular crystal grain/twinned crystal grain mixture, diameter/ thickness ratio 2.5) | 0.30 as silver |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-8 | $3.0 \times 10^{-2}$ |
| ExM-9 | 0.20 |
| ExY-13 | $3.0 \times 10^{-2}$ |
| Cpd-11 | $7.0 \times 10^{-3}$ |
| Solv-1 | 0.20 |
| Eighth Layer (Intermediate Speed Green Sensitive Emulsion Layer) | |
| Silver iodobromide emulsion (AgI 4 mol %, internal high AgI type, corresponding sphere diameter 0.55 μm, variation coefficient of corresponding sphere diameter 20%, regular crystal grain/twinned crystal grain mixture, diameter/ thickness ratio 4.0) | 0.70 as silver |
| Gelatin | 1.00 |
| ExS-4 | $5.0 \times 10^{-4}$ |
| ExS-5 | $2.0 \times 10^{-4}$ |
| ExS-6 | $3.0 \times 10^{-4}$ |
| ExM-8 | $3.0 \times 10^{-2}$ |

-continued

| | |
|---|---|
| ExM-9 | 0.25 |
| ExM-10 | $1.5 \times 10^{-2}$ |
| ExY-13 | $4.0 \times 10^{-2}$ |
| Cpd-11 | $9.0 \times 10^{-3}$ |
| Solv-1 | 0.20 |
| Ninth Layer (High Speed Green Sensitive Emulsion Layer) | |
| Silver iodobromide emulsion (AgI 10 mol %, high internal AgI type, corresponding sphere diameter 0.55 μm, variation coefficient of corresponding sphere diameter 18%, twinned crystal grain, diameter/ thickness ratio 7.5) | 0.50 as silver |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-8 | $2.0 \times 10^{-2}$ |
| ExM-11 | $6.0 \times 10^{-2}$ |
| ExM-12 | $2.0 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| Tenth Layer (Yellow Filter Layer) | |
| Gelatin | 0.90 |
| Yellow colloidal silver | $5.0 \times 10^{-2}$ |
| Cpd-1 | 0.20 |
| Solv-1 | 0.15 |
| Eleventh Layer (Low Speed Blue Sensitive Emulsion Layer) | |
| Silver iodobromide emulsion (AgI 4 mol %, internal high AgI type, corresponding sphere diameter 0.5 μm, variation coefficient of the corresponding sphere diameter 15%, octahedral grains) | 0.40 as silver |
| Gelatin | 1.00 |
| ExS-8 | $2.0 \times 10^{-4}$ |
| ExY-13 | $9.0 \times 10^{-2}$ |
| ExY-15 | 0.90 |
| Cpd-2 | $1.0 \times 10^{-2}$ |
| Solv-1 | 0.30 |
| Twelfth Layer (Second Blue Sensitive Emulsion Layer) | |
| Silver iodobromide emulsion (AgI 10 mol %, internal high AgI type, corresponding sphere diameter 1.3 μm, variation coefficient of the corresponding sphere diameter 25%, regular crystal grain/twinned crystal grain mixture, diameter/ thickness ratio 4.5) | 0.50 as silver |
| Gelatin | 0.60 |
| ExS-8 | $1.0 \times 10^{-4}$ |
| ExY-15 | 0.12 |
| Cpd-2 | $1.0 \times 10^{-3}$ |
| Solv-1 | $4.0 \times 10^{-2}$ |
| Thirteenth Layer (First Protective Layer) | |
| Fine grained silver iodobromide (average grain size 0.07μ, AgI 1 mol %) | 0.20 |
| Gelatin | 0.80 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| Fourteenth Layer (Second Protective Layer) | |
| Gelatin | 0.90 |
| B-1 (Diameter 1.5 μm) | 0.10 |
| B-2 (Diameter 1.5 μm) | 0.10 |
| B-3 | $2.0 \times 10^{-2}$ |
| H-1 | 0.40 |

*The term "corresponding sphere diameter" means the diameter calculated in terms of sphere, and hereinafter the same.

Moreover, Cpd-3, Cpd-5, Cpd-6, Cpd-7, Cpd-8, p-1, W-1, W-2 and W-3 indicated below were added in order to improve storage properties, processing properties and pressure resistance, for biocidal and fungicidal purposes, for anti-static purposes and to improve coating properties.

n-Butyl p-hydroxybenzoate was added in addition to the above mentioned compounds. Moreover, B-4, F-1, F-4, F-5, F-6, F-7, F-8, F-9, F-10, F-11 and F-13, and iron salts, lead salts, gold salts, platinum salts, iridium salts and rhodium salts were included.

The structural formulae or chemical names of the compounds used in this example are indicated below.

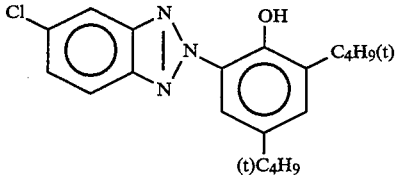

UV-1

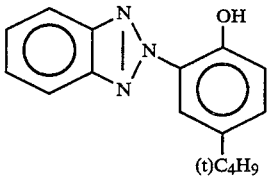

UV-2

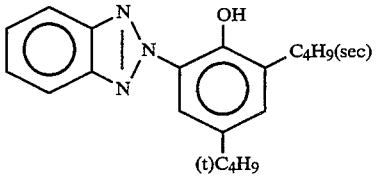

UV-3

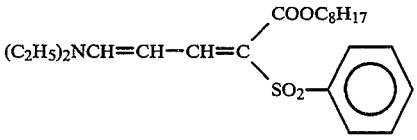

UV-4

Tricresyl phosphate

Solv-1 Dibutyl phthalate

Solv-2

Tri(2-ethylhexyl) phosphate

Solv-3

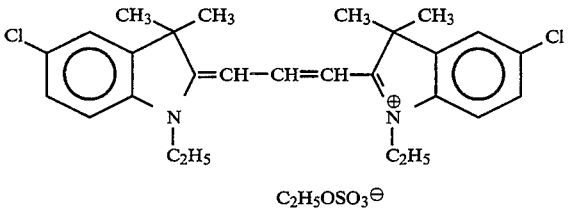

ExF-1

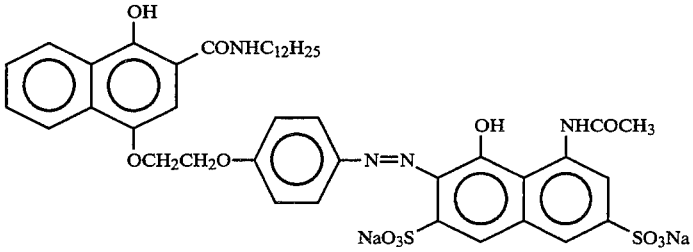

ExC-2

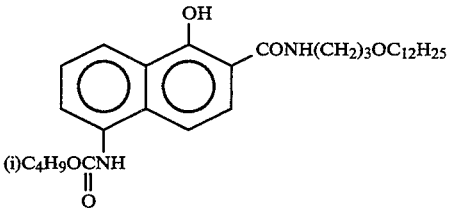

ExC-3

-continued
ExC-4
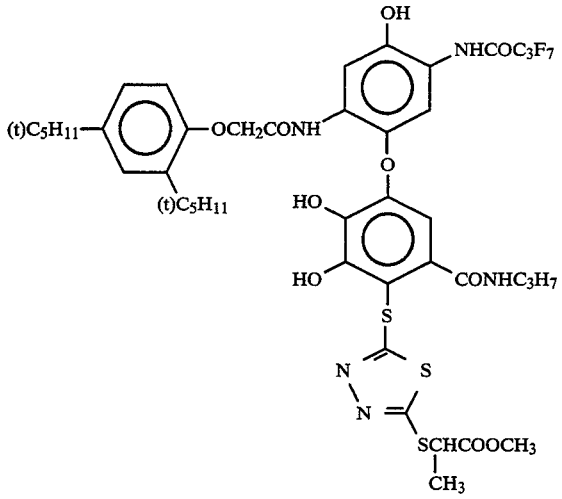
ExC-5
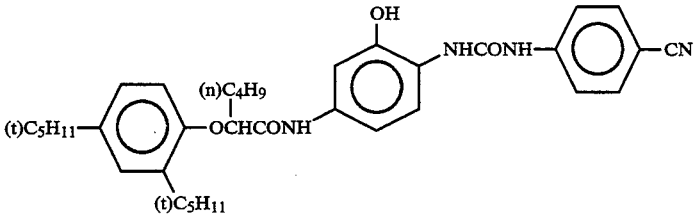
ExC-6
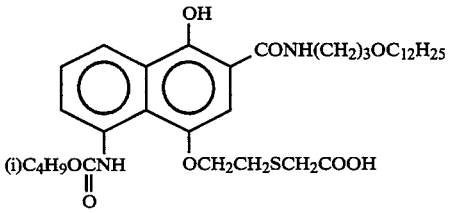
ExM-8
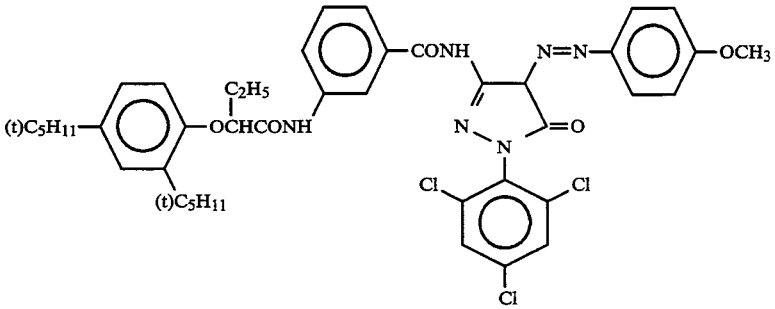
ExM-9
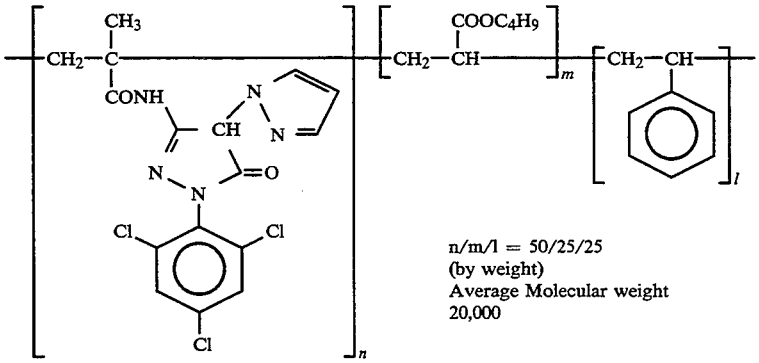
n/m/l = 50/25/25
(by weight)
Average Molecular weight
20,000

-continued
ExM-10
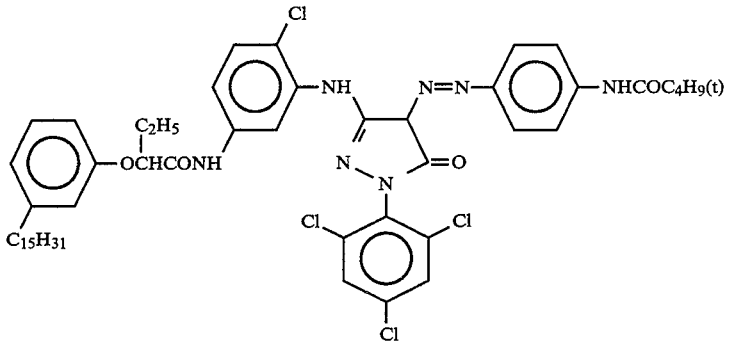
ExM-11
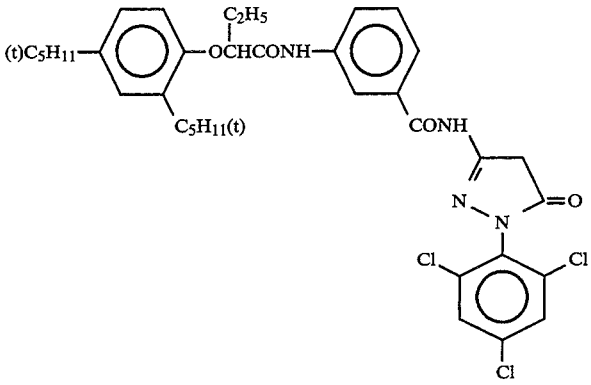
ExM-12
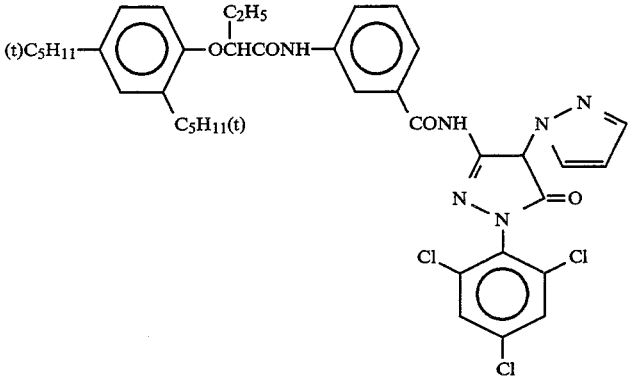
ExY-13
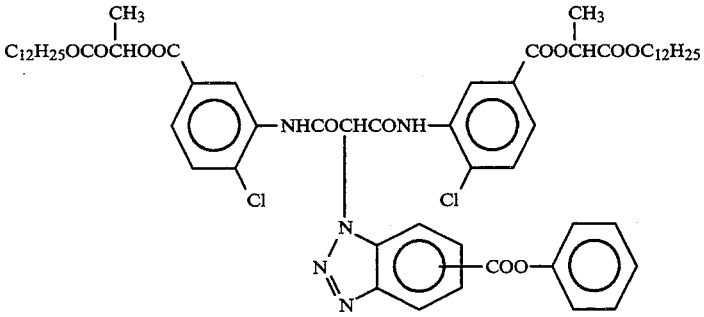

-continued
ExY-14
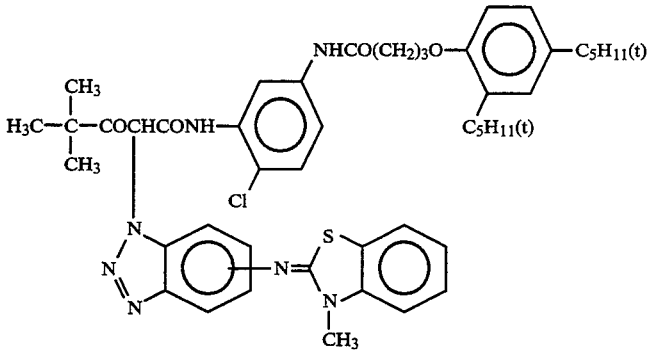
ExY-15
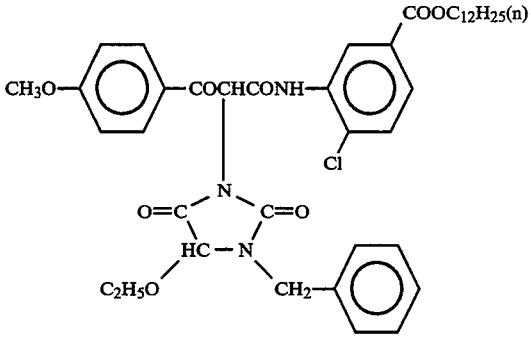
Cpd-1
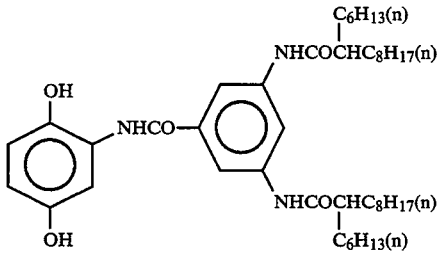
Cpd-2
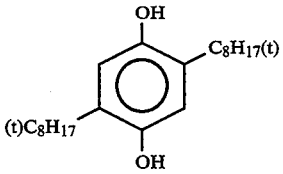
Cpd-3
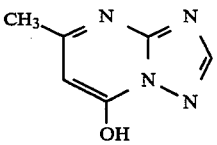
Cpd-4
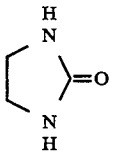
Cpd-5
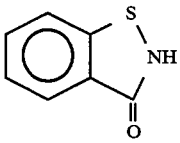
Cpd-6
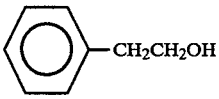
Cpd-7
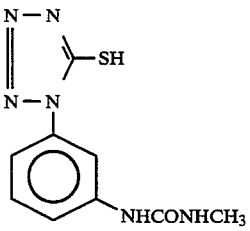
Cpd-8
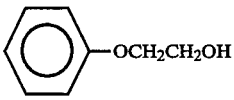
Cpd-9
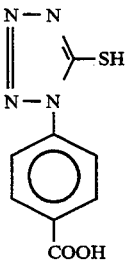

-continued
Cpd-10
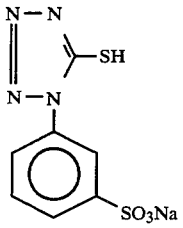
Cpd-11
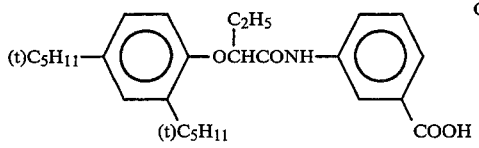
ExS-1
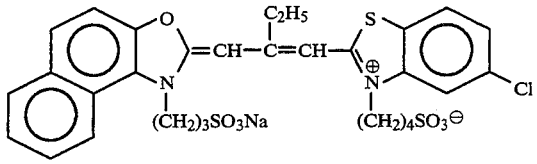
ExS-2
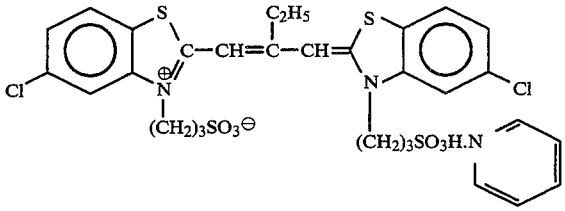
ExS-3
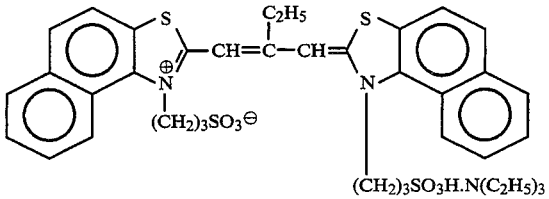
ExS-4
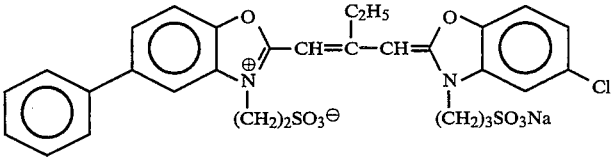
ExS-5
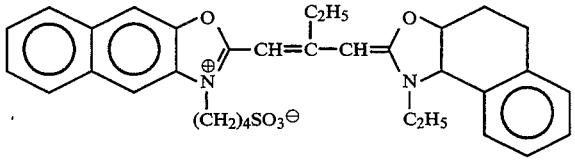
ExS-6
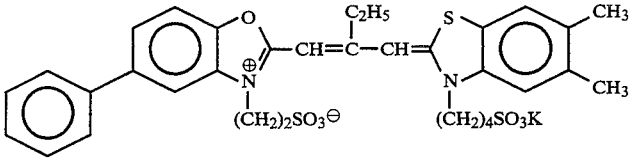
ExS-7
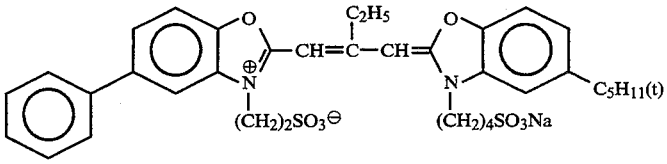

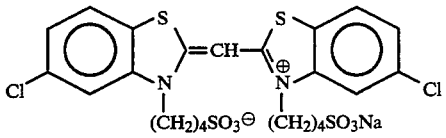
$CH_2{=}CH{-}SO_2{-}CH_2{-}CONH{-}CH_2$
$CH_2{=}CH{-}SO_2{-}CH_2{-}CONH{-}CH_2$
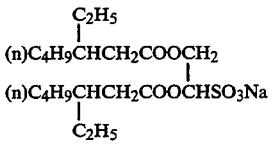
Vinylpyrrolidone/vinyl alcohol copolymer
(Copolymer ratio (by weight) = 70:30
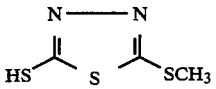
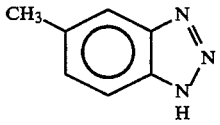
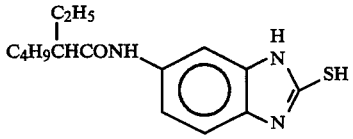
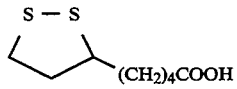
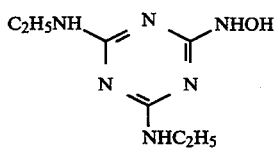
Comparative Coupler (a) (Coupler (6) of JP-B-63-39889 (corresponding to U.S. Pat. No. 4,409,323))
-continued
ExS-8
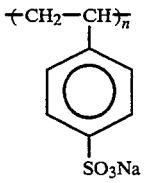
B-4
H-1
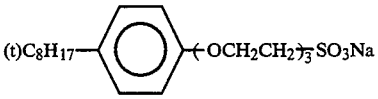
W-1
W-2 $C_8F_{17}SO_2N(C_3H_7)CH_2COOK$ W-3
P-1 Poly(ethyl acrylate) P-2
F-1
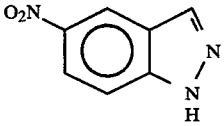
F-4
F-5
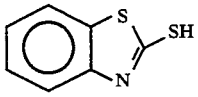
F-6
F-7
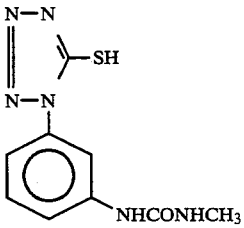
F-8
F-9
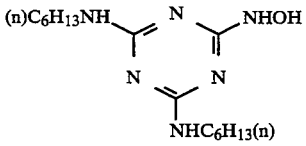
F-10
F-11
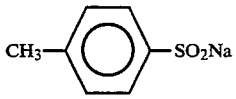
F-13
Comparative Coupler (b) (Coupler (12) of JP-B-63-39889 (corresponding to U.S. Pat. No. 4,409,323))

-continued
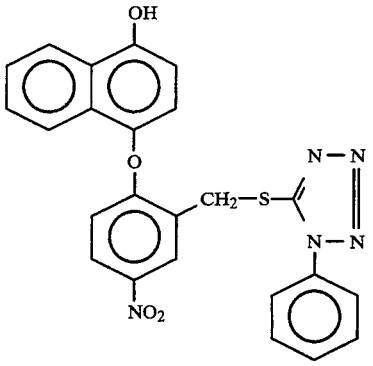
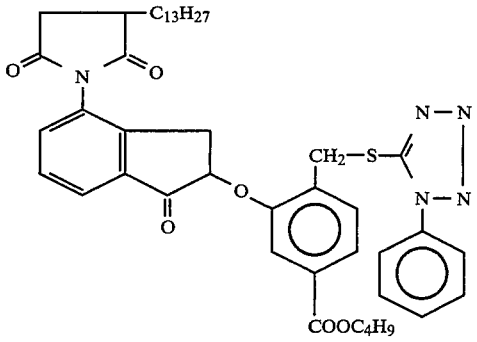
Comparative Coupler (c) (Coupler (7) of JP-A-60-218645)
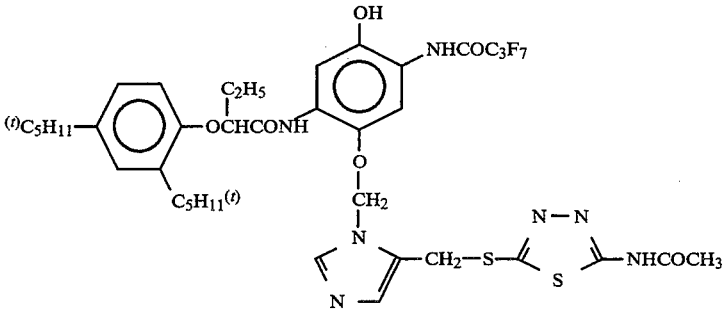
Comparative Coupler (d) (Coupler (19) of JP-A-60-218645)
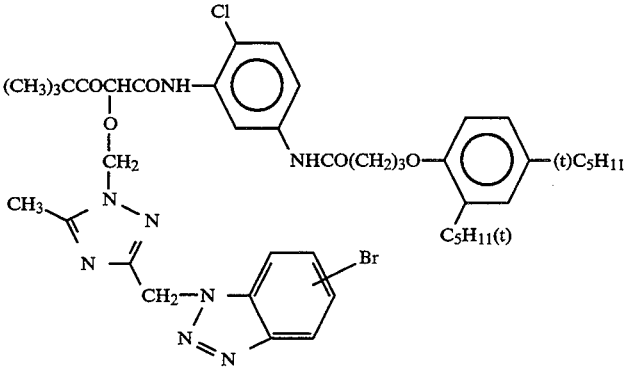
Comparative Coupler (e) (Compound (13) of JP-A-1-154057)
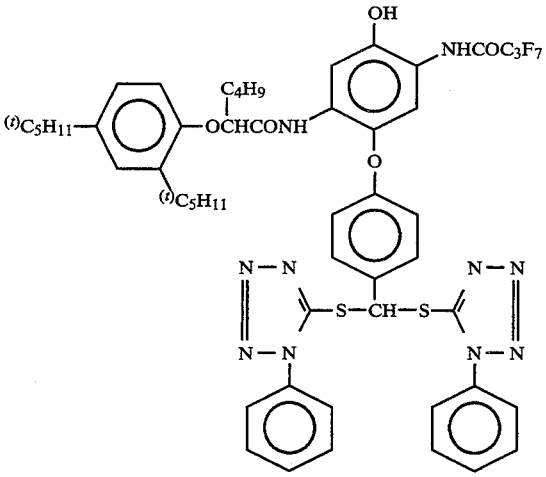
Comparative Coupler (f) (the coupler disclosed in Example 49 of JP-A-63-37346)

-continued

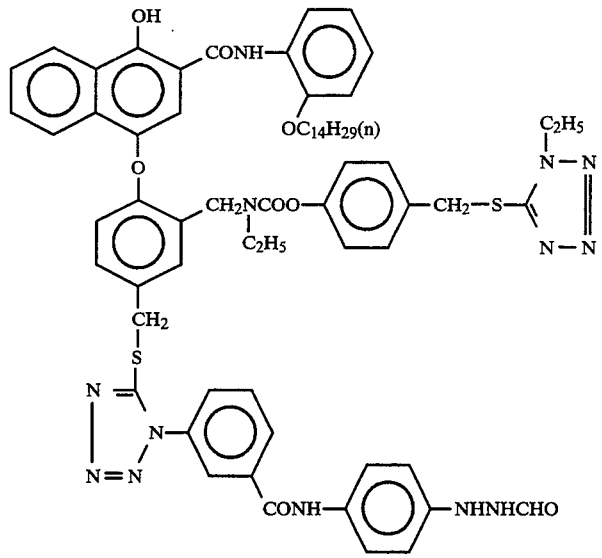

Samples 102–111

Sample 102 was prepared by adding 0.0045 g/m$^2$ of coupler (1) of the present invention to the third layer and 0.0085 g/m$^2$ of coupler (1) of the present invention to the fourth layer of Sample 101.

Samples 103 to 111 were prepared by replacing coupler (1) used in the present invention in Sample 102 with an equal weight of other couplers of the present invention and comparative couplers as shown in Table 1 below.

Sample 112 and 113

Samples 112 and 113 were prepared by adjusting the amount of comparative coupler added in such a way as to provide more or less the same gradation as that of Samples 102 to 105 in which a coupler of the present invention had been used.

These samples were exposed to white light and then subjected to color development processing as indicated below. The gamma values were obtained as the gradient of the straight line joining the points of cyan density (fog+0.2) and (fog+1.2) in each case. Sharpness was measured by processing in the same way and using the normal MTF method, and the value for the cyan image, 25 cycles/nun, was obtained. Furthermore, after imagewise exposure through a red filter (SC-62, made by Fuji Photo Film Co.), samples were subjected to a uniform 0.05 CMS exposure with a green filter (BPN-45 made by Fuji Photo Film Co.), developed and processed. The degree of color mixing obtained by subtracting the magenta density at the cyan fog density from the magenta density at a cyan density of 1.5 was as shown in Table 1.

Furthermore, samples were irradiated with soft X-rays with apertures of 500 μm×4 cm and 15 μm×4 cm and the cyan density ratio of the respective centers was obtained as the edge effect.

Additionally, samples which had been subjected to the above mentioned imagewise exposure were stored for 10 days under conditions of 50° C., 80% relative humidity and then color developed in the same way as before, and the change in speed on taking the logarithm of the reciprocal of the exposure for a cyan density of (fog +0.2) as a relative speed was as shown in Table 1.

Color development processing was carried out as indicated below using an automatic processor.

TABLE 1

| Sample | Coupler added to the third and fourth layers Type | Amount | Gamma | Degree of color mixing | MTF Value | Edge effect | Change in speed under forced degradation conditions |
|---|---|---|---|---|---|---|---|
| 101 Control | — | — | 0.80 | −0.02 | 0.60 | 1.25 | +0.01 |
| 102 This Invention | (1) | 1.0 | 0.64 | −0.14 | 0.70 | 1.42 | +0.01 |
| 103 This Invention | (2) | 1.0 | 0.66 | −0.12 | 0.69 | 1.40 | +0.01 |
| 104 This Invention | (8) | 1.0 | 0.68 | −0.10 | 0.68 | 1.37 | +0.02 |
| 105 This Invention | (16) | 1.0 | 0.69 | −0.10 | 0.68 | 1.37 | +0.02 |
| 106 Comparative Example | (a) | 1.0 | 0.81 | −0.02 | 0.60 | 1.26 | +0.03 |
| 107 Comparative Example | (b) | 1.0 | 0.77 | −0.04 | 0.62 | 1.28 | −0.02 |
| 108 Comparative Example | (c) | 1.0 | 0.74 | −0.04 | 0.63 | 1.28 | +0.03 |
| 109 Comparative Example | (d) | 1.0 | 0.76 | −0.06 | 0.63 | 1.30 | −0.02 |
| 110 Comparative Example | (e) | 1.0 | 0.70 | −0.07 | 0.65 | 1.32 | −0.12 |
| 111 Comparative Example | (f) | 1.0 | 0.83 | −0.05 | 0.58 | 1.28 | −0.07 |
| 112 Comparative Example | (b) | 8.0 | 0.65 | −0.07 | 0.65 | 1.33 | −0.04 |

TABLE 1-continued

| Sample | Coupler added to the third and fourth layers Type | Amount | Gamma | Degree of color mixing | MTF Value | Edge effect | Change in speed under forced degradation conditions |
|---|---|---|---|---|---|---|---|
| 113 Comparative Example | (c) | 6.0 | 0.65 | −0.07 | 0.65 | 1.33 | +0.03 |

| Process | Processing Time | Processing Temp. |
|---|---|---|
| Color development | 3 minutes 15 seconds | 38° C. |
| Bleaching | 6 minutes 30 second | 38° C. |
| Water Wash | 2 minutes 10 seconds | 24° C. |
| Fixing | 4 minutes 20 seconds | 38° C. |
| Water Wash (1) | 1 minute 05 seconds | 24° C. |
| Water Wash (2) | 1 minute 00 seconds | 24° C. |
| Stabilization | 1 minute 05 seconds | 38° C. |
| Drying | 4 minutes 20 seconds | 55° C. |

The composition of each processing bath is indicated below.

| | (Units: grams) |
|---|---|
| Color Developer | |
| Diethylenetriamine penta-acetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxy-ethylamino]-2-methylaniline sulfate | 4.5 |
| Water to make | 1.0 liter |
| pH | 10.05 |
| Bleach Bath | |
| Ethylenediamine tetra-acetic acid ferric sodium salt tri-hydrate | 100.0 |
| Ethylenediamine tetra-acetic acid di-sodium salt | 10.0 |
| Ammonium bromide | 140.0 |
| Ammonium nitrate | 30.0 |
| Aqueous ammonia (27 wt %) | 6.5 ml |
| Water to make | 1.0 liter |
| pH | 6.0 |
| Fixing Bath | |
| Ethylenediamine tetra-acetic acid di-sodium salt | 0.5 |
| Sodium sulfite | 7.0 |
| Sodium bisulfite | 5.0 |
| Aqueous ammonium thiosulfate solution (70 w/v %) | 170.0 ml |
| Water to make | 1.0 liter |
| pH | 6.7 |
| Stabilizer | |
| Formalin (37 w/v %) | 2.0 ml |
| Polyoxyethylene p-monononyl-phenyl ether (average degree of polymerization 10) | 0.3 |
| Ethylenediamine tetra-acetic acid di-sodium salt | 0.05 |
| Water to make | 1.0 liter |
| pH | 5.0–8.0 |

It is clear from Table 1 that with samples in which a conventional coupler had been used, there was little effect on the degree of color mixing or sharpness when small amounts of the conventional coupler were added as illustrated in Comparative Examples 106 to 110. In addition, Comparative Samples 111 and 112 having a large amount of a conventional coupler were inferior in sharpness and color reproduction to Samples 102 to 105 having a small amount of a coupler of the present invention. Thus the effectiveness of the couplers of the present invention can be seen.

Furthermore, used of the couplers of the present invention generally resulted in less change in photographic characteristics on ageing prior to development after exposure.

EXAMPLE 2

Sample 201, a multi-layer color photographic material comprised of the layers of which the compositions are indicated below, was prepared on a cellulose triacetate film support on which a subbing-layer had been established.

Composition of the Photosensitive Layer

Coated weights are shown in units of grams/m$^2$ as silver in the case of silver halides and colloidal additives and gelatin, and in units of mol per mol of silver halide in the same layer in the case of the sensitizing dyes. Moreover, the codes used for the additives have the significance indicated below. However, in those cases where a compound has several effects it is listed under just one of these effects. UV: Ultraviolet absorber, Solv: High boiling point organic solvent, ExF: Dye, ExS: Sensitizing dye, ExC: Cyan coupler, ExM: Magenta coupler, ExY: Yellow coupler, Cpd: Compound.

| | |
|---|---|
| First Layer (Anti-halation Layer) | |
| Black colloidal silver | 0.15 |
| Gelatin | 2.33 |
| ExM-6 | 0.11 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| Second Layer (Low Speed Red Sensitive Emulsion Layer) | |
| Silver iodobromide emulsion (4.0 mol % AgI, uniform AgI type, corresponding sphere diameter 0.4 μm, variation coefficient of the corresponding sphere diameter 30%, plate-like grains, diameter/thickness ratio 3.0) | 0.35 as silver |
| Silver iodobromide emulsion (6.0 mol % AgI, core/shell ratio 1:2 internal high AgI type, corresponding sphere diameter 0.45 μm, variation coefficient of the corresponding sphere diameter 23%, plate-like grains, diameter/thickness ratio 2.0) | 0.18 as silver |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |

-continued

| | |
|---|---|
| ExS-7 | $4.1 \times 10^{-6}$ |
| ExC-1 | 0.17 |
| ExC-2 | $4.0 \times 10^{-2}$ |
| ExC-3 | $8.0 \times 10^{-2}$ |
| Comparative coupler (a) | $5.0 \times 10^{-3}$ |

Third Layer (Intermediate Speed Red Sensitive Emulsion Layer)

| | |
|---|---|
| Silver iodobromide emulsion (6.0 mol % AgI, core/shell ratio 1:2 internal high AgI type, corresponding sphere diameter 0.65 μm, variation coefficient of the corresponding sphere diameter 23%, plate-like grains, diameter/thickness ratio 2.0) | 0.80 as silver |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.38 |
| ExC-2 | $2.0 \times 10^{-2}$ |
| ExC-3 | 0.12 |
| ExM-7 | $3.0 \times 10^{-2}$ |
| UV-2 | $5.7 \times 10^{-2}$ |
| UV-3 | $5.7 \times 10^{-z}$ |
| Comparative coupler (a) | $3.0 \times 10^{-3}$ |

Fourth Layer (High Speed Red Sensitive Emulsion Layer)

| | |
|---|---|
| Silver iodobromide emulsion (9.3 mol % AgI, multi-structure grains of core/shell ratio 3:4:2, AgI content from the inside 24, 0, 6 mol %, corresponding sphere diameter 0.75 μm variation coefficient of the corresponding sphere diameter 23%, plate-like grains, diameter/thickness ratio 2.5) | 1.49 as silver |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| Comparative coupler (a) | $2.0 \times 10^{-3}$ |
| Solv-1 | 0.20 |
| Solv-2 | 0.53 |

Fifth Layer (Intermediate Layer)

| | |
|---|---|
| Gelatin | 0.62 |
| Cpd-1 | 0.13 |
| Poly(ethyl acrylate) latex | $8.0 \times 10^{-2}$ |
| Solv-1 | $8.0 \times 10^{-2}$ |

Sixth Layer (Low Speed Green Sensitive Emulsion Layer)

| | |
|---|---|
| Silver iodobromide emulsion (4.0 mol % AgI, uniform AgI type, corresponding sphere diameter 0.33 μm, variation coefficient of the corresponding sphere diameter 37%, plate-like grains, diameter/thickness ratio 2.0) | 0.19 as silver |
| Gelatin | 0.44 |
| ExS-3 | $1.5 \times 10^{-4}$ |
| ExS-4 | $4.4 \times 10^{-4}$ |
| ExS-5 | $9.2 \times 10^{-5}$ |
| ExM-5 | 0.17 |
| ExM-7 | $3.0 \times 10^{-2}$ |
| Solv-1 | 0.13 |
| Solv-4 | $1.0 \times 10^{-2}$ |

Seventh Layer (Intermediate Speed Green Sensitive Emulsion Layer)

| | |
|---|---|
| Silver iodobromide emulsion (4.0 mol % AgI, uniform AgI type, corresponding sphere diameter 0.55 μm, variation coefficient of the corresponding sphere diameter 15%, plate-like grains, diameter/thickness ratio 4.0) | 0.24 as silver |
| Gelatin | 0.54 |
| ExS-3 | $2.1 \times 10^{-4}$ |
| ExS-4 | $6.3 \times 10^{-4}$ |
| ExS-5 | $1.3 \times 10^{-4}$ |
| ExM-5 | 0.15 |
| ExM-7 | $4.0 \times 10^{-2}$ |
| ExY-8 | $1.0 \times 10^{-2}$ |
| Solv-1 | 0.13 |
| Solv-4 | $1.0 \times 10^{-2}$ |

Eighth Layer (High Speed Green Sensitive Emulsion Layer)

| | |
|---|---|
| Silver iodobromide emulsion (8.8 mol % AgI, multi-structure grains of core/shell ratio 3:4:2, AgI content from the inside 24, 0, 3 mol %, corresponding sphere diameter 0.75 μm variation coefficient of the corresponding sphere diameter 23%, plate-like grains, diameter/thickness ratio 1.6) | 0.49 as silver |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-5 | $8.0 \times 10^{-2}$ |
| ExM-6 | $3.0 \times 10^{-2}$ |
| ExY-8 | $1.0 \times 10^{-2}$ |
| ExC-1 | $1.0 \times 10^{-2}$ |
| ExC-4 | $1.0 \times 10^{-2}$ |
| Solv-1 | 0.23 |
| Solv-2 | $5.0 \times 10^{-2}$ |
| Solv-4 | $1.0 \times 10^{-2}$ |
| Cpd-8 | $1.0 \times 10^{-2}$ |

Ninth Layer (Intermediate Layer)

| | |
|---|---|
| Gelatin | 0.56 |
| Cpd-1 | $4.0 \times 10^{-2}$ |
| Poly(ethylene acrylate) latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |

Tenth Layer (Donor Layer Having an Interimage Effect on the Red Sensitive Layer)

| | |
|---|---|
| Silver iodobromide emulsion (8.0 mol % AgI, internal high AgI type of core/shell ratio 1:2, corresponding sphere diameter 0.65 μm, variation coefficient of the corresponding sphere diameter 25%, plate-like grains, diameter/thickness ratio 2.0) | 0.67 as silver |
| Silver iodobromide emulsion (4.0 mol % AgI, uniform AgI type, corresponding sphere diameter 0.4 μm, variation coefficient of the corresponding sphere diameter 30%, plate-like grains, diameter/thickness ratio 3.0) | 0.20 as silver |
| Gelatin | 0.87 |
| ExS-3 | $6.7 \times 10^{-4}$ |
| ExM-10 | 0.12 |
| Solv-1 | 0.30 |
| Solv-6 | $3.0 \times 10^{-2}$ |

Eleventh Layer (Yellow Filter Layer)

| | |
|---|---|
| Yellow colloidal silver | $9.0 \times 10^{-2}$ |
| Gelatin | 0.84 |
| Cpd-2 | 0.13 |
| Solv-1 | 0.13 |
| Cpd-1 | $8.0 \times 10^{-2}$ |
| Cpd-6 | $2.0 \times 10^{-3}$ |
| H-1 | 0.25 |

Twelfth Layer (Low Speed Green Sensitive Emulsion Layer)

| | |
|---|---|
| Silver iodobromide emulsion (4.5 mol % AgI, uniform AgI type, corresponding sphere diameter 0.7 m, variation coefficient of the corresponding sphere diameter 15%, plate-like grains, diameter/thickness ratio 7.0) | 0.50 as silver |
| Silver iodobromide emulsion (3.0 mol % AgI, uniform AgI type, corresponding sphere | 0.30 as silver |

-continued

| | |
|---|---|
| diameter 0.3 μm, variation coefficient of the corresponding sphere diameter 30%, plate-like grains, diameter/thickness ratio 7.0) | |
| Gelatin | 2.18 |
| ExS-6 | $9.0 \times 10^{-4}$ |
| ExC-1 | 0.14 |
| ExY-9 | 0.17 |
| ExY-11 | 1.09 |
| Solv-1 | 0.54 |
| Thirteenth Layer (Intermediate Layer) | |
| Gelatin | 0.40 |
| ExY-12 | 0.10 |
| Solv-1 | 0.19 |
| Fourteenth Layer (High Speed Blue Sensitive Emulsion layer) | |
| Silver iodobromide emulsion (10.0 mol % AgI, internal high AgI type, corresponding sphere diameter 1.0 μm, variation coefficient of the corresponding sphere diameter 25%, Multiple twinned crystal plate-like grains, diameter/thickness ratio 2.0) | 0.40 as silver |
| Gelatin | 0.49 |
| ExS-6 | $2.6 \times 10^{-4}$ |
| ExY-9 | $1.0 \times 10^{-2}$ |
| ExY-11 | 0.20 |
| ExC-1 | $1.0 \times 10^{-2}$ |
| Solv-1 | $9.0 \times 10^{-2}$ |
| Fifteenth Layer (First Protective Layer) | |
| Fine grained silver iodobromide emulsion (2.0 mol % AgI, uniform AgI type, corresponding sphere diameter 0.07 μm) | 0.12 as silver |
| Gelatin | 0.63 |
| UV-4 | 0.11 |
| UV-5 | 0.18 |
| Solv-5 | $2.0 \times 10^{-2}$ |
| Cpd-5 | 0.10 |
| Poly(ethyl acrylate) latex | $9.0 \times 10^{-2}$ |
| Sixteenth Layer (Second Protective Layer) | |
| Fine grained silver iodobromide emulsion (2.0 mol % AgI, uniform AgI type, corresponding sphere diameter 0.07 μm) | 0.36 as silver |
| Gelatin | 0.85 |
| B-1 (diameter 1.5 μm) | $8.0 \times 10^{-2}$ |
| B-2 (diameter 1.5 μm) | $8.0 \times 10^{-2}$ |
| B-3 | $2.0 \times 10^{-2}$ |
| W-4 | $2.0 \times 10^{-2}$ |
| H-1 | 0.18 |

Apart from the above, 1,2-benzisothiazolin-3-one (average 200 ppm with respect to the gelatin), n-butyl p-hydroxybenzoate (1,000 ppm with respect to the gelatin) and 2-phenoxyethanol (10,000 ppm with respect to the gelatin) were added to the sample prepared in this way. Moreover, B-4, B-5, F-1, F-2, F-3, F-4, F-5, F-6, F-7, F-8, F-9, F-10, F-11, F-12, F-13 and iron salts, lead salts, gold salts, platinum salts, iridium salts and rhodium salts were included.

Apart for the components indicated above, the surfactants W-1, W-2 and W-3 were added to each layer as coating aids and emulsifying and dispersing agents.

UV-1

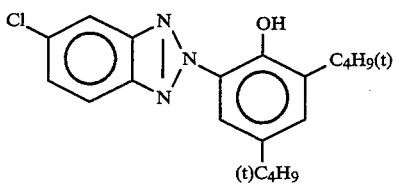

UV-2

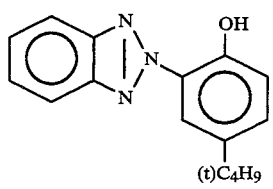

UV-3

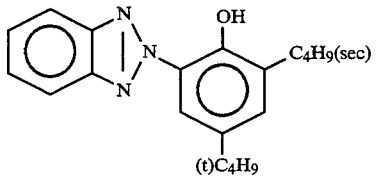

UV-4

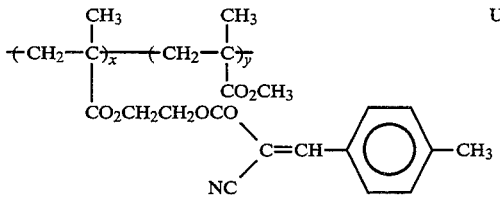

x:y = 70:30 (wt %)

UV-5

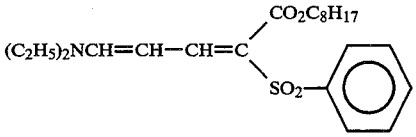

Tricresyl phosphate Solv-1

Dibutyl phthalate Solv-2

Solv-4

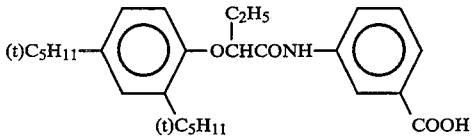

Trihexyl phosphate Solv-5

Solv-6

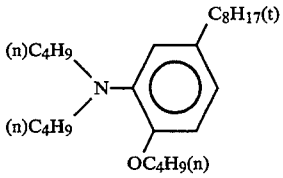

-continued
ExF-1
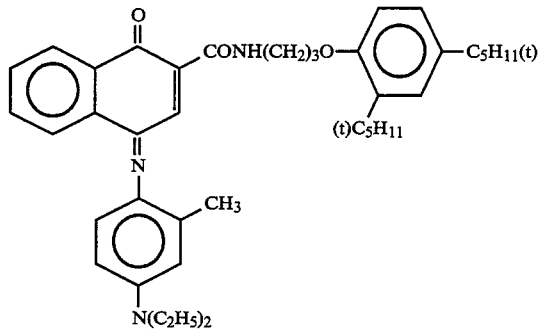
ExF-2
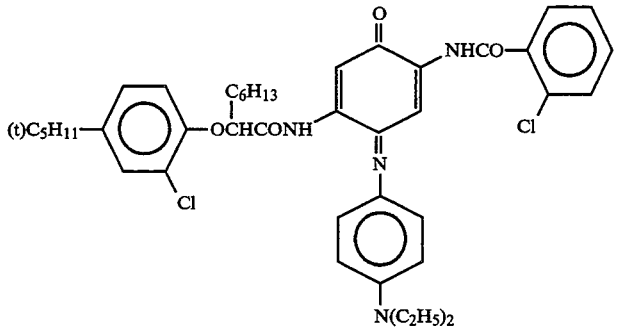
ExF-3
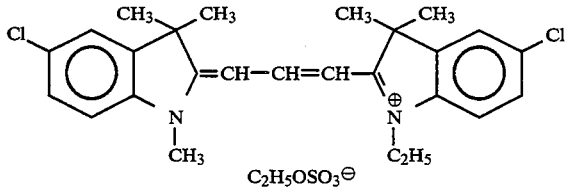
ExC-1
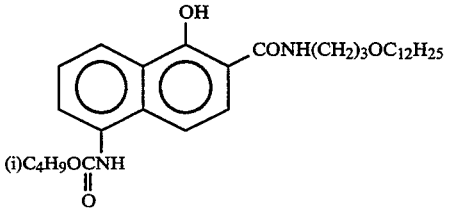
ExC-2
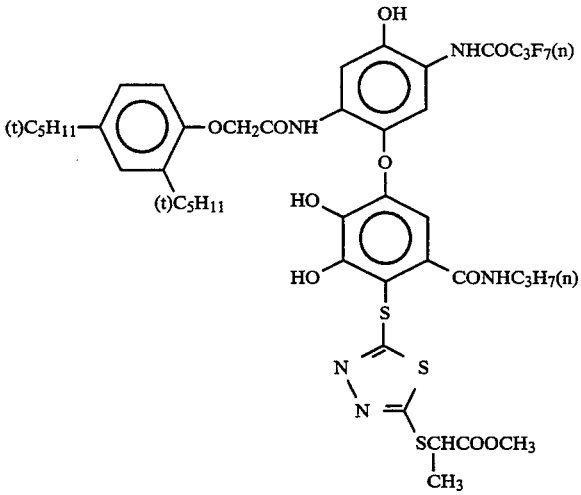

-continued
ExC-3
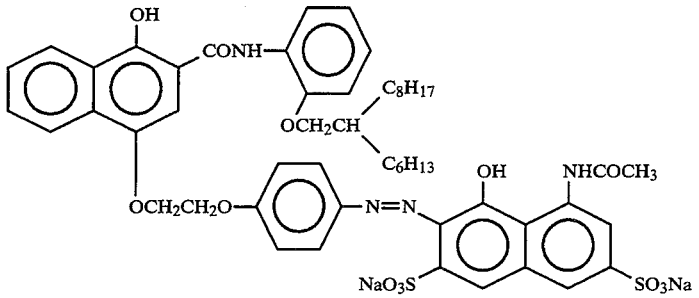
ExC-4
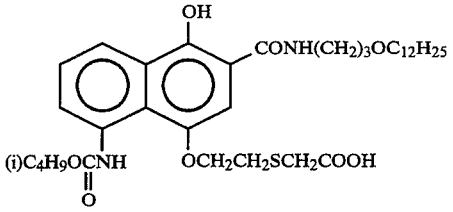
ExM-5
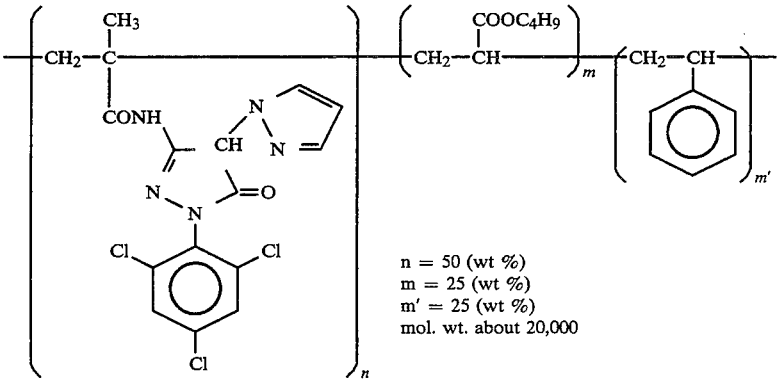
ExM-6
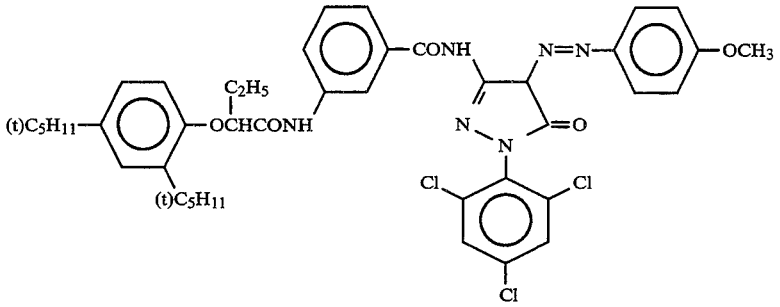
ExM-7
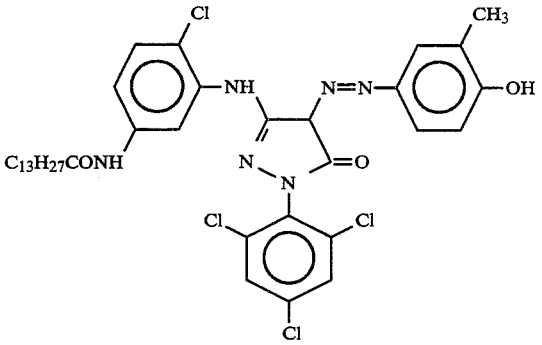

-continued
ExM-10
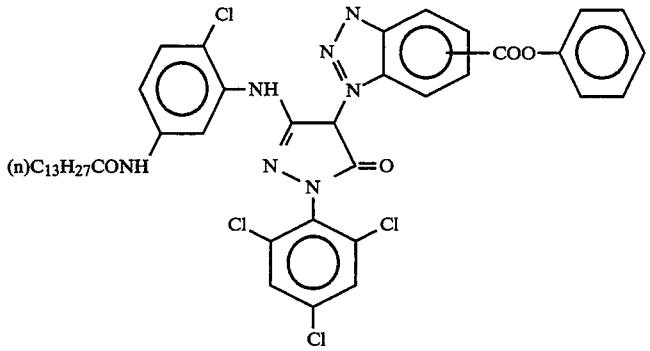
ExY-8
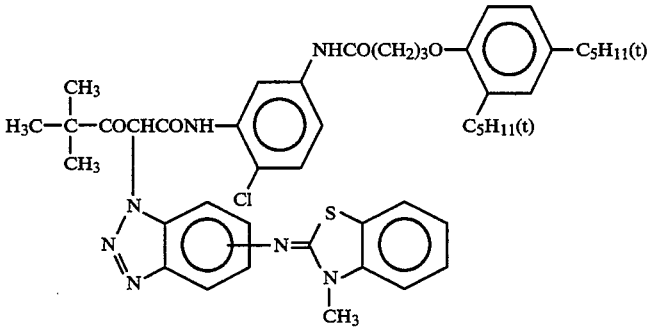
ExY-9
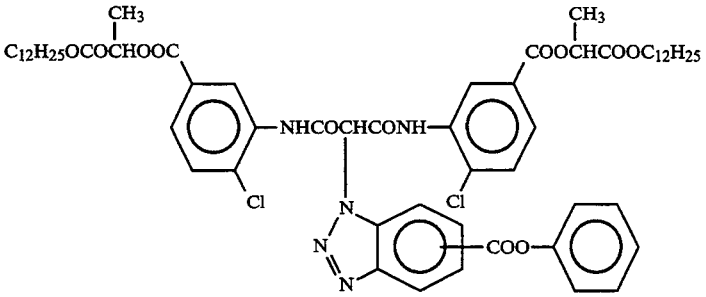
ExY-11
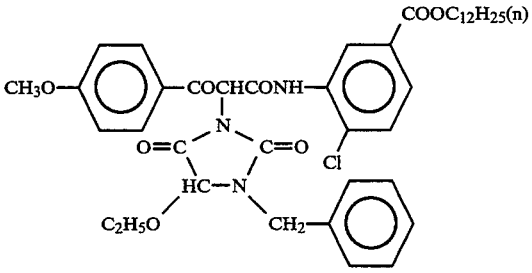
ExY-12
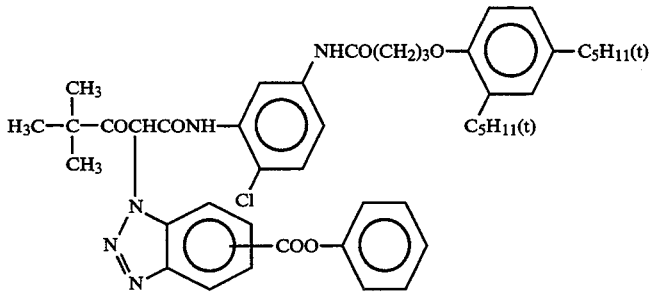

-continued
Cpd-1
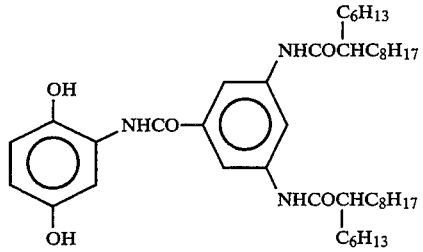
Cpd-2
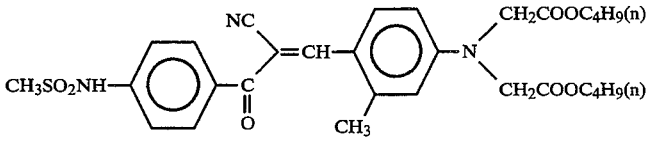
Cpd-5
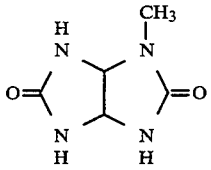
Cpd-6
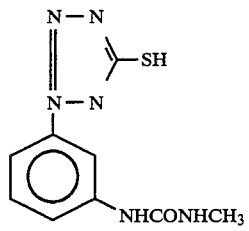
Cpd-8
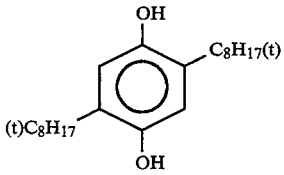
H-1
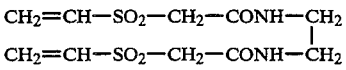
W-1
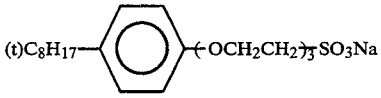
W-2
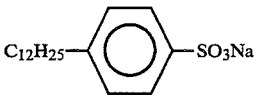
W-3
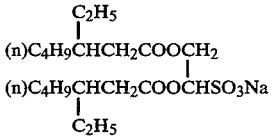
W-4
$C_8F_{17}SO_2N(C_3H_7)CH_2COOK$
ExS-1
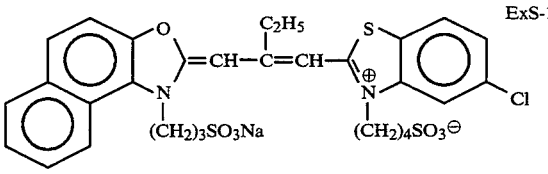
ExS-2
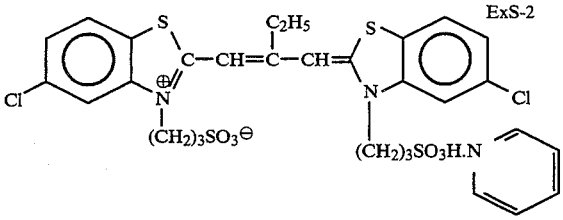
ExS-3
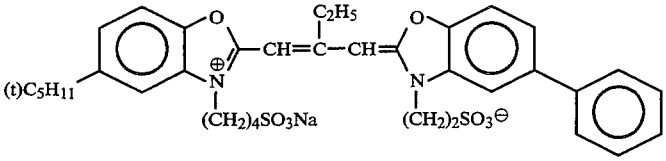
ExS-4
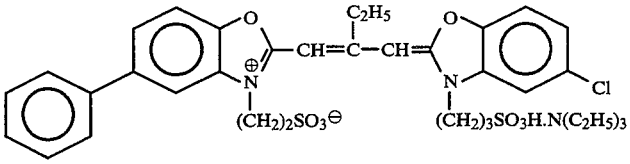

-continued
ExS-5
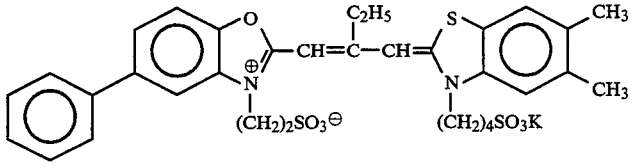
ExS-6
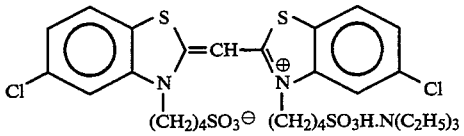
ExS-7
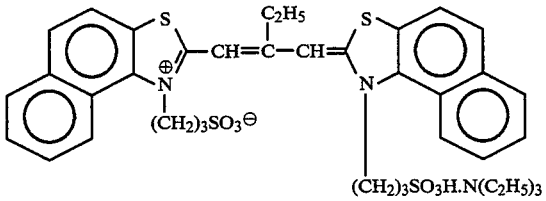
ExS-8
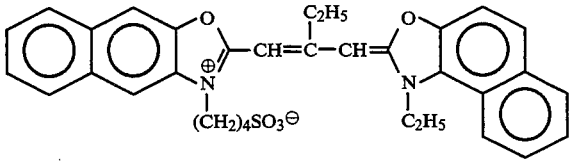
F-1
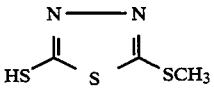
F-2
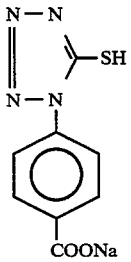
F-3
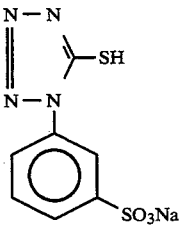
F-4
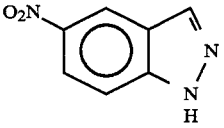
F-5
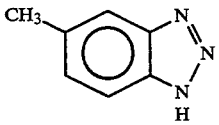
F-6
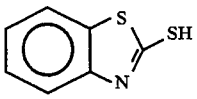
F-7
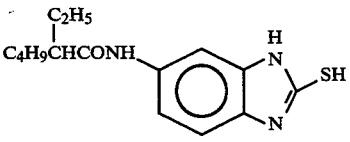
F-8
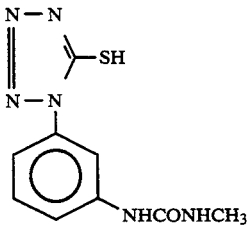

-continued

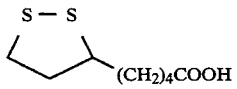

F-9

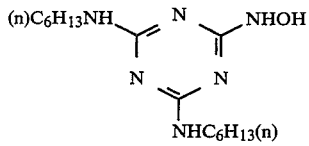

F-10

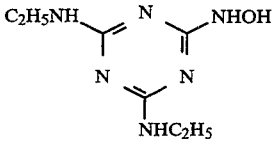

F-11

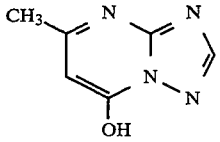

F-12

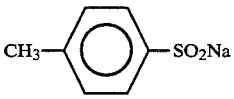

F-13

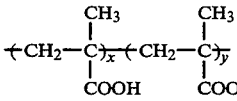

x/y = 10/90 by mol

B-1

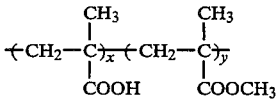

x/y = 40/60 by mol

B-2

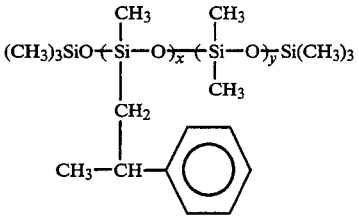

x/y = 29/46 by weight

B-3

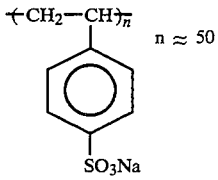

B-4

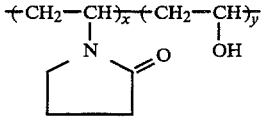

x/y = 70/30 by weight

Samples 202 to 210

Samples 202 to 210 were prepared by replacing the comparative coupler (a) of Sample 201 with an equal weight of other couplers as shown in Table 2.

These samples were irradiated with soft X-rays in the same way as in Example 1, and then they were color developed in the way indicated below and the edge effect was measured.

-continued

| | | |
|---|---|---|
| Diethylenetriamine penta-acetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |

Color Development Processing

| Process | Processing Time | Processing Temp. | Replenishment Rate* | Tank Capacity |
|---|---|---|---|---|
| Color development | 3 min. 15 sec. | 38° C. | 45 ml | 10 liters |
| Bleach | 1 min. 00 sec. | 38° C. | 20 ml | 4 liters |
| Bleach-fix | 3 min. 15 sec. | 38° C. | 30 ml | 8 liters |
| Water Wash (1) | 40 seconds | 35° C. | (Note 1) | 4 liters |
| Water Wash (2) | 1 min. 00 sec. | 35° C. | 30 ml | 4 liters |
| Stabilization | 40 seconds | 38° C. | 20 ml | 4 liters |
| Drying | 1 min. 15 sec. | 55° C. | | |

*Replenishment rate per meter of 35 mm wide material
Note 1:
Counter flow system from water wash (2) to water wash (1)

The composition of each processing bath was as indicated below.

| Color Developer | Parent Bath (grams) | Replenisher (grams) |
|---|---|---|
| 4-[N-ethyl-N-β-hydroxy-ethylamino]-2-methylaniline sulfate | 4.5 | 5.5 |
| Water to make | 1.0 liter | 1.0 liter |
| pH | 10.05 | 10.10 |

| Bleach (Parent Bath = Replenisher) | (Units: Grams) |
|---|---|

-continued

| | |
|---|---|
| Ethylenediamine tetra-acetic acid, ferric ammonium salt, di-hydrate | 120.0 |
| Ethylenediamine tetra-acetic acid, di-sodium salt | 10.0 |
| Ammonium bromide | 100.0 |
| Ammonium nitrate | 10.0 |
| Bleach accelerator | 0.005 mol |

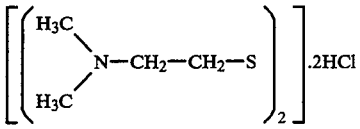

| | |
|---|---|
| Aqueous ammonia (27 wt %) | 15.0 ml |
| Water to make | 1.0 liter |
| pH | 6.3 |

| Bleach-Fixer Parent Bath = Replenisher | (Units: Grams) |
|---|---|
| Ethylenediamine tetra-acetic acid, ferric ammonium salt, di-hydrate | 50.0 |
| Ethylenediamine tetra-acetic acid, di-sodium salt | 5.0 |
| Sodium sulfite | 12.0 |
| Aqueous ammonium thiosulfate solution (70 w/v %) | 240.0 ml |
| Aqueous ammonia (27 wt %) | 6.0 ml |
| Water to make | 1.0 liter |
| pH | 7.2 |

Wash Water Parent Bath=Replenisher

Town water was passed through a mixed bed type column which had been packed with an H-type strongly acidic cation exchange resin ("Amberlite IR-120B", made by the Rohm and Haas Co.) and an OH-type anion exchange resin ("Amberlite IRA-400", made by the same company) and treated in such a way that the calcium and magnesium ion concentrations each were not more than 3 mg/l, after which 20 mg/l of sodium isocyanurate dichloride and 0.15 g/l of sodium sulfate were added. The pH of this solution was within the range from 6.5 to 7.5.

| Stabilizer Parent Bath = Replenisher | (Units: Grams) |
|---|---|
| Formalin (37 w/v %) | 2.0 ml |
| Polyoxyethylene p-monononyl-phenyl ether (average degree of polymerization 10) | 0.3 |
| Ethylenediamine tetra-acetic acid, di-sodium salt | 0.05 |
| Water to make | 1.0 liter |
| pH | 0.5–8.0 |

TABLE 2

| Sample | Compound | Edge Effect |
|---|---|---|
| 201 (Comparative Ex.) | (a) | 1.30 |
| 202 (Comparative Ex.) | (b) | 1.31 |
| 203 (Comparative Ex.) | (c) | 1.31 |
| 204 (Comparative Ex.) | (d) | 1.33 |
| 205 (Invention) | (1) | 1.46 |
| 206 (Invention) | (2) | 1.45 |
| 207 (Invention) | (9) | 1.42 |
| 208 (Invention) | (10) | 1.43 |
| 209 (Invention) | (14) | 1.41 |
| 210 (Invention) | (30) | 1.40 |

It is clear from Table 2 that the samples of this invention had a greater edge effect and were superior in respect of sharpness.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising on a support, at least one photosensitive silver halide emulsion layer, which contains a coupler represented by formula (I) which releases a plurality of development inhibitors, each development inhibitor being represented by PUG, which are attached, either directly or through a timing group $L_1$, to different atoms of a timing group $L_2$:

$$A-(L_1)_l-(L_2)_m\text{-}[(L_1)_n-PUG]_s \quad (I)$$

wherein A represents a coupler residual group, the timing group $L_1$ represents a divalent timing group, the timing group $L_2$ has a valence of 3 or more, and PUG represents one of formulae (INH-1) to (INH-8) and (INH-10) to (INH-13), l and n each represents 0, 1 or 2, m represents 1 or 2, and s represents a number obtained by subtracting 1 from the valence of $L_2$, being an integer of at least 2:

(INH-1)

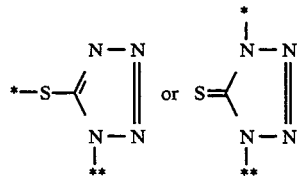

(INH-2)

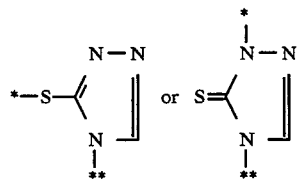

(INH-3)

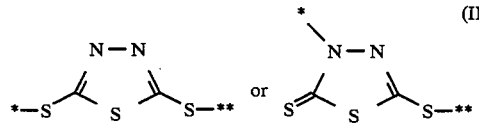

(INH-4)

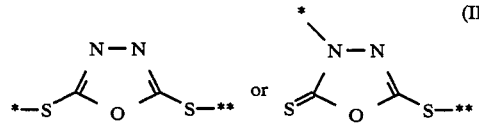

(INH-5)

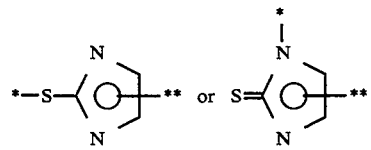

(INH-6)

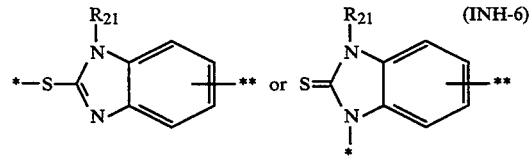

-continued

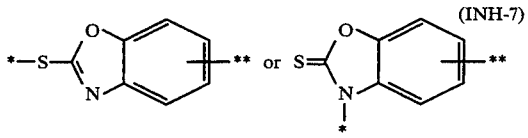

(INH-7)

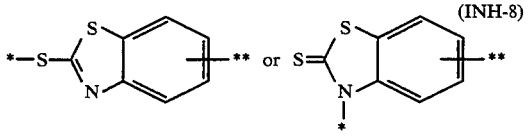

(INH-8)

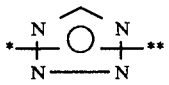

(INH-10)

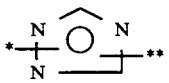

(INH-11)

wherein $R_{21}$ represents a hydrogen atom or a substituted or unsubstituted hydrocarbyl group, * indicates the position at which the group represented by $L_1$ and $L_2$ of the compound represented by general formula (I) is bonded, and ** indicated a position at which a substituent group is bonded.

2. A silver halide photographic material as in claim 1, wherein at least one timing group is of the electron transfer type.

3. A silver halide photographic material as in claim 1, wherein at least one timing group is of the azole type.

4. A silver halide photographic material as in claim 1, wherein A represents a coupling group represented by the following general formulae (Cp-1), (Cp-2), (Cp-3), (Cp-4), (Cp-5), (Cp-6), (Cp-7), (Cp-8), (Cp-9) or (Cp-10):

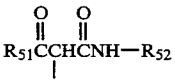

(Cp-1)

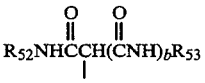

(Cp-2)

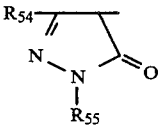

(Cp-3)

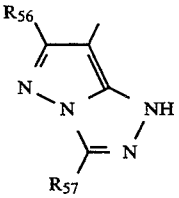

(Cp-4)

-continued

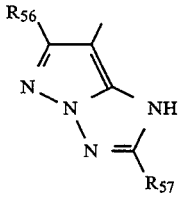

(Cp-5)

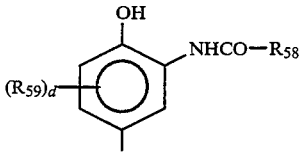

(Cp-6)

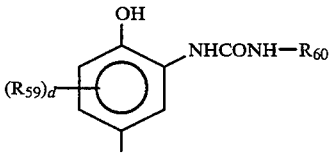

(Cp-7)

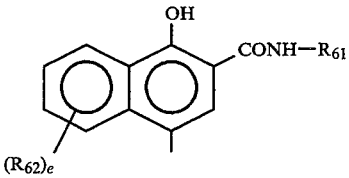

(Cp-8)

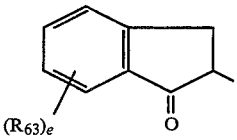

(Cp-9)

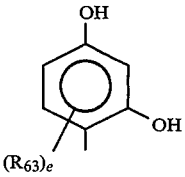

(Cp-10)

Wherein $R_{41}$ represents an aliphatic group, an aromatic group or a heterocyclic group; $R_{42}$ represents an aromatic group or a heterocyclic group; and $R_{43}$, $R_{44}$ and $R_{45}$ each represents a hydrogen atom, an aliphatic group, an aromatic group or a heterocyclic group;

$R_{51}$ represents a group as defined for $R_{41}$;

$R_{52}$ and $R_{53}$ each represents a group as defined for $R_{42}$;

b represents an integer of 0 or 1;

$R_{54}$ represents a group as defined for $R_{41}$, an $R_{41}CON(R_{43})$— group, an $R_{41}N(R_{43})$— group, an $R_{41}SO_2N(R_{43})$— group, an $R_{41}S$— group, an $R_{43}O$— group, an $R_{45}NCON(R_{43})(R_{44})$—

-group, or an N≡C group;

$R_{55}$ represents a group as defined for $R_{41}$;

$R_{56}$ and $R_{57}$ each represents a group as defined for $R_{43}$, an $R_{41}S$— group, an $R_{43}O$— group, an $R_{41}CON(R_{43})$— group, or an $R_{41}SO_2N(R_{43})$— group;

$R_{58}$ represents a group as defined for $R_{41}$;

$R_{59}$ represents a group as defined for $R_{41}$, an $R_{41}CON(R_{43})$— group, an $R_{41}OCON(R_{43})$— group, an $R_{41}SO_2N(R_{43})$— group, an $R_{43}NCON(R_{44})$— group, $R_{41}O$— group, an $R_{41}S$— group, a halogen atom or an $R_{41}N(R_{43})$— group;

d represents an integer from 0 to 3, and when d represents 2 or more, the two or more $R_{59}$'s may be the same or different, or each of the two $R_{59}$'s may be a divalent group and connected with each other to form a ring structure;

$R_{60}$ represents a group as defined for $R_{41}$;

$R_{61}$ represents a group as defined for $R_{41}$;

$R_{62}$ represents a group as defined for $R_{41}$, an $R_{41}O$-CONH— group, an $R_{41}SONH$— group, an $R_{43}NCON(R_{44})(R_{45})$— group, an $R_{43}NSO_2N(R_{44})(R_{45})$— group, an $R_{43}O$— group, an $R_{41}S$— group, a halogen atom or an $R_{41}N(R_{43})$— group;

$R_{63}$ represents a group as defined for $R_{41}$, an $R_{43}CON(R_{44})(R_{45})$— group, an $R_{43}NCO(R_{44})$— group, an $R_{41}SO_2N(R_{44})$— group, an $R_{43}NSO_2(R_{44})$— group, an $R_{41}SO_2$— group, an $R_{43}OCO$— group, an $R_{43}OSO_2$— group, a halogen atom, a nitro group, a cyano group or an $R_{43}CO$— group; and e represents an integer from 0 to 4, and when e is 2 or more, the two or more $R_{62}$'s or $R_{63}$'s may be the same or different.

5. A silver halide photographic material as in claim 1, wherein $L_1$ is represented by the following general formulae (T-1), (T-2), (T-3), (T-4), (T-5), or (T-6):

$$*\text{—}(W\text{—}C(R_{11})(R_{12}))_t\text{—}** \quad \text{(T-1)}$$

wherein * indicates the position at which A, $L_1$ or $L_2$ of the compound represented by general formula (I) is bonded, and ** indicates the position at which $L_1$, $L_2$ or PUG are bonded; W represents an oxygen atom, a sulfur atom or an $-N(R_{13})-$ group, $R_{11}$ and $R_{12}$ each represents a hydrogen atom or substituent group, $R_{13}$ represents a substituent group and t represents 1 or 2, and when t is 2, the two $-W-C(R_{11})(R_{12})-$ groups may be the same or different;

$$*\text{—Nu—Link—E—}** \quad \text{(T-2)}$$

wherein Nu represents a nucleophilic group, E represents an electrophilic group, being a group which is subjected to nucleophilic attack by Nu and with which the bond marked ** can be cleaved, and Link is a linking group which enables Nu and E to have a steric arrangement such that an intramolecular nucleophilic substitution reaction can occur;

$$*\text{—}W\text{—}\left[Z_1(R_{11})_x=Z_2(R_{12})_y\right]_t\text{—}CH_2\text{—}** \quad \text{(T-3)}$$

wherein, *, **, W, $R_{11}$, $R_{12}$ and t all have the same meaning as described above in connection with general formula (T-1); $R_{11}$ and $R_{12}$ may be joined together to form a benzene ring or a structural part of a heterocyclic ring; or $R_{11}$ and $R_{12}$ and W may be joined together to form a benzene ring or a heterocyclic ring;

$Z_1$ and $Z_2$ each independently represents a carbon atom or a nitrogen atom, and x and y represent 0 or 1;

when t is 2, the two $-\left[Z_1(R_{11})_x=Z_2(R_{12})_y\right]-$ groups may be the same or different;

$$*\text{—}O\text{—}C(=O)\text{—}** \quad \text{(T-4)}$$

$$*\text{—}S\text{—}C(=S)\text{—}** \quad \text{(T-5)}$$

-continued

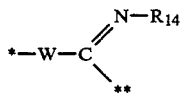

(T-6)

wherein * and ** in (T-4), (T-5) and (T-6) have the same meaning as described in general formula (T-1), in general formula (T-6) W have the same meaning as described in connection with general formula (T-1), and $R_{14}$ has the same significance as $R_{13}$.

6. A silver halide photographic material as in claim 1, wherein $L_2$ represents an electron transfer type timing group having a valence of at least 3.

7. A silver halide photographic material as in claim 1, wherein $L_2$ is represented by general formula (T-$L_2$),

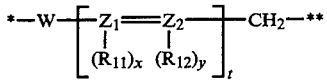

(T-$L_2$)

wherein W represents an oxygen atom, a sulfur atom or an

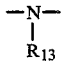

group (where $R_{13}$ represents a substituent group), $R_{11}$ and $R_{12}$ each represents a hydrogen atom or a substituent group, $Z_1$ and $Z_2$ each independently represents a carbon atom or a nitrogen atom, X and Y each represents 0 or 1, t represents 1 or 2, * indicates the position at which A—$(L_1)_l$— in general formula (I) is bonded, and ** indicates the position at which $(L_1)$n-PUG in general formula (I) is bonded and at least one of the plurality of $R_{11}$ or $R_{12}$ groups is bonded to —$(L_1)_n$—PUG with a substituted or unsubstituted methylene group.

8. A silver halide photographic material as in claim 1, wherein the coupler is present in an amount from $1\times10^{-7}$ to $5\times10^{-4}$ mol/m$^2$.

9. A silver halide photographic material as in claim 8, wherein the coupler is present in an amount from $1\times10^{-6}$ to $2\times10^{-4}$ mol/m$^2$.

10. A silver halide photographic material as in claim 9, wherein the coupler is present in an amount from $5\times10^{-6}$ to $1\times10^{-4}$ mol/m$^2$.

* * * * *